US009160062B2

(12) United States Patent
Goettl et al.

(10) Patent No.: US 9,160,062 B2
(45) Date of Patent: Oct. 13, 2015

(54) METHOD FOR OPERATING A PHASE-CONTROLLED GROUP ANTENNA AND PHASE SHIFTER ASSEMBLY AND AN ASSOCIATED PHASE-CONTROLLED GROUP ANTENNA

(75) Inventors: Maximilian Goettl, Frasdorf (DE); Michael Boss, Rosenheim (DE)

(73) Assignee: KATHREIN-WERKE KG, Rosenheim (DE)

( * ) Notice: Subject to any disclaimer, the term of this patent is extended or adjusted under 35 U.S.C. 154(b) by 751 days.

(21) Appl. No.: 13/318,255

(22) PCT Filed: Apr. 8, 2010

(86) PCT No.: PCT/EP2010/002202

§ 371 (c)(1),
(2), (4) Date: Nov. 28, 2011

(87) PCT Pub. No.: WO2010/124787

PCT Pub. Date: Nov. 4, 2010

(65) Prior Publication Data

US 2012/0105299 A1 May 3, 2012

(30) Foreign Application Priority Data

Apr. 30, 2009 (DE) ..... 10 2009 019 557

(51) Int. Cl.
*H01Q 21/00* (2006.01)
*H01P 1/18* (2006.01)
(Continued)

(52) U.S. Cl.
CPC ..... *H01Q 1/246* (2013.01); *H01Q 3/30* (2013.01); *H01Q 21/22* (2013.01)

(58) Field of Classification Search
CPC ..... H01Q 21/00; H01P 1/18
USPC ..... 343/853; 333/161
See application file for complete search history.

(56) References Cited

U.S. PATENT DOCUMENTS 5,710,569 A 1/1998 Oh et al.
5,917,455 A 6/1999 Huynh et al.
(Continued)

FOREIGN PATENT DOCUMENTS

CN 1359548 A 7/2002
CN 201146243 Y 11/2008
(Continued)

OTHER PUBLICATIONS

Notification of the First Office Action dated Jun. 26, 2013, issued in Chinese Application No. 201080016124.9.
(Continued)

*Primary Examiner* — Dameon E Levi
*Assistant Examiner* — Andrea Lindgren Baltzell
(74) *Attorney, Agent, or Firm* — Nixon & Vanderhye P.C.

(57) ABSTRACT

The invention relates to an improved method for operating a phase-controlled group antenna as well as an associated phase shifter assembly and a phase-controlled group antenna, characterized by, inter alia, the following features: the phase shifter assembly is designed such that at least one of the following two conditions is met: $R_N$: $R_1 \geq n+k$ ud/or $Ph_N$: $Ph_1 \geq n+k$, where $R_N$ is the largest radius, and $R_1$ is the smallest radius of a conductor segment (11) relative to the phase shifter assembly (7), where k is a value of 0.2 and particularly 0.25, 0.30, or preferably 0.40.

11 Claims, 25 Drawing Sheets

(51) Int. Cl.

| | |
|---|---|
| ***H01Q 1/24*** | (2006.01) |
| ***H01Q 3/30*** | (2006.01) |
| ***H01Q 21/22*** | (2006.01) |

(56) References Cited

U.S. PATENT DOCUMENTS

| | | | | |
|---|---|---|---|---|
| 6,693,588 | B1 * | 2/2004 | Schlee | 342/368 |
| 2004/0051677 | A1 * | 3/2004 | Gottl | 343/797 |
| 2005/0219133 | A1 * | 10/2005 | Elliot | 343/757 |
| 2005/0264448 | A1 * | 12/2005 | Cox et al. | 343/700 MS |

FOREIGN PATENT DOCUMENTS

| | | | | |
|---|---|---|---|---|
| DE | 197 22 742 | | 12/1998 | |
| DE | 198 23 749 | | 12/1999 | |
| DE | 101 50 150 | | 5/2003 | |
| EP | 1 208 614 | | 9/2003 | |
| EP | 2 083 477 | | 7/2009 | |
| WO | WO 96/37922 | | 11/1996 | |
| WO | WO 00/39894 | | 7/2000 | |
| WO | WO 01/13459 | | 2/2001 | |
| WO | WO 02/35651 | | 5/2002 | |
| WO | WO 03/019723 | | 3/2003 | |
| WO | WO 2008/048149 | * | 4/2008 | H01Q 3/30 |

OTHER PUBLICATIONS

International Search Report for PCT/EP2010/002202, mailed Aug. 13, 2010.

German-language Written Opinion of the International Searching Authority for PCT/EP2010/002202, mailed Aug. 13, 2010.

* cited by examiner

METHOD FOR OPERATING A PHASE-CONTROLLED GROUP ANTENNA AND PHASE SHIFTER ASSEMBLY AND AN ASSOCIATED PHASE-CONTROLLED GROUP ANTENNA

CROSS-REFERENCES TO RELATED APPLICATIONS

This application is a U.S. national phase application of International Application No. PCT/EP2010/002202, filed Apr. 8, 2010, which designated the U.S. and claims priority to Germany Application No. 10 2009 019 557.2, filed Apr. 30, 2009, the entire contents of which is hereby incorporated by reference.

STATEMENT REGARDING FEDERALLY SPONSORED RESEARCH OR DEVELOPMENT

Not applicable.

FIELD

The invention relates to a method for operating a phase-controlled group antenna, and to a phase shifter assembly, and to an associated phase-controlled group antenna.

BACKGROUND AND SUMMARY

Phase-controlled group antennas are known, for example, from mobile communications technology.

Mobile communications antennas are normally used for base stations and consist of one or more columns arranged side by side, in each of which a plurality of radiators or sub-groups of radiators are arranged above one another. The radiators may be single polarised or dual polarised radiators. The antennas may be formed as mono-band, dual-band or as multi-band antennas which comprise radiators which can transmit and receive in a plurality of frequencies or frequency ranges (frequency bands). In terms of the structure of such group antennas as well as radiators and radiator arrangements, reference is made in this regard to previously known solutions, for example to prior publications WO 00/39894 A1, DE 197 22 742 A1, DE 198 23 749 A1, DE 101 50 150 A1 or, for example, U.S. Pat. No. 5,710,569.

Since, in a mobile communications system, the number of available channels is limited, the same frequencies are used again at specific distances. The range of a base station, defining a "mobile communications cell", is therefore to be limited so that the cells of the mobile communications system do not disturb one another, that is to say are not subject to interferences.

It is therefore known to set the group antennas for such base stations with a different downtilt angle depending on requirements.

Whilst in the early days of mobile communications technology this downtilt angle could be set in different ways by mechanical measures, systems are now preferred in which, for example, a different downtilt angle can be set remotely and, depending on requirements and traffic level, can also be changed constantly.

On this basis phase shifters and, more precisely, phase shifter systems are preferably used to control the individual radiators using different phase positions, whereby a different downtilt angle can be set electrically.

For example, it is thus known to use differential phase shifters, as are known in principle from EP 1 208 614 B1. An odd number of radiators or sub-groups of radiators can be controlled by such a single phase or multi-phase shifter, wherein a central radiator or a central radiator group is preferably fed directly without phase shift. For example, two radiators or radiator groups can be controlled at the outputs thereof by a differential phase shifter with different phase shift. If, in each case, two further radiators or sub-groups of radiators are to be controlled, again with increased propagation-time changes and therefore with different phase positions, a further single phase shifter is required in each case, or a multi-phase shifter is used, as proposed in accordance with EP 1 208 614 B1.

Instead of group antennas, which comprise at least one radiator or a radiator group and which are operated without phase shift, group antennas which comprise an even number of radiators or radiator groups and/or do not comprise a radiator group and are operated without phase shift are also considered in principle.

The use of a single phase shifter to control sub-groups of radiators can be inferred, for example, from U.S. Pat. No. 5,917,455 A.

WO 03/019723 A1 describes an adjustable antenna feed network comprising a phase shifter means which is constructed in such a way that identical phase differences can be generated at the ports leading to the radiators by a movable dielectric.

WO 02/35651 A1 also describes the use of phase shifters in which a dielectric is moved along a stripline. The shift path is always the same. However, since the effective dielectricity numbers are different, phase shifts which each have the same phase differences from one another can be performed at the radiator ports. A substantially straight wave front with a different downtilt angle can thus be produced.

The corresponding phase shifter elements which can be used with the same objective as explained above are also to be inferred as being known in principle from WO 96/37922 A1.

Lastly, an antenna arrangement for lowering a downtilt angle or for setting the direction of radiation of the primary beam in the azimuth direction is also to be inferred as being known from US 2005/0219133 A1. In this prior publication an antenna arrangement comprising a phase shifter assembly with use of differential phase shifters is described, wherein the outputs of a first phase shifter arrangement are connected to the inputs of a respective second phase shifter assembly in order to thus control the radiator elements. A further possibility of a phase shifter network according to the prior art is also described in this prior publication and comprises a phase shifter assembly which includes two circular-segment-shaped phase shifter line portions which are arranged concentrically and are fed by a common feed arm which can be pivoted in a pointer-shaped manner about a common centre point.

By contrast, as an improved variant the prior publication cited above suggests using phase shifters, the two outputs of each of which are directly connected to radiator elements. In other words, a single-stage construction is thus used which is provided a number of times for two radiator elements in each case. For an antenna arrangement comprising a plurality of radiators which are to be fed with different phases, different phase shifters are therefore used in each case and are controlled by means of a transmission drive in such a way that different phase delays can be set for the individual radiator elements or radiator groups. A specific ratio between the pivoting of the phase shifters, for example of 1:3, 1:3:5, 1:3:5:7 and so on, to achieve a correspondingly fixed predetermined phase delay value is to be maintained in accordance with the number of phase shifters used and the arrangement of the radiators. Tolerances of +/−5% are acceptable. In order to optimise a radiation pattern, for example in the form of secondary lobes, it may be desirable in an alternative embodiment to vary the aforementioned ratios.

However, the correspondingly different adjustment of a downtilt angle in order to change the size of a corresponding mobile communications cell does not always lead to the desired success since the secondary lobes are nevertheless also shifted by the tilting (downtilt) of the primary radiation lobe. For example, the situation may arise that the first secondary lobe above the primary beam direction arrives in the vicinity of the horizontal plane (or even therebeneath) with increasing tilting of the main beam direction, with the result that mobile communications devices and base stations then act as interferers from another coverage area. A low secondary lobe level would thus be desirable.

On the other hand, however, the antenna gain is also to be as high as possible so as to guide the available transmission power effectively to the desired coverage area. A high antenna gain means a high bundling of the energy. In terms of the feed of group antennas, it is known however from the specialist literature that the optimisation of the antenna gain is often accompanied by an increase in the secondary lobe level.

The object of the present invention is therefore to provide an improved method for operating a phase-controlled group antenna as well as an improved phase-controlled group antenna itself, in which the first secondary lobe above or adjacent to the primary lobe has the lowest possible level, in particular with substantial beam tilt (large downtilt angle) or large beam pivoting (in order to suppress interference) and/or generally has a maximum antenna gain with slight beam tilt (that is to say with large cell expansion and illumination) or with slight beam pivoting.

It is highly surprising that, within the scope of the invention, the aforementioned objectives can be achieved by relatively simple means which are almost mutually exclusive. A tilting of the level of the first secondary lobe above the primary lobe with a considerably lowered downtilt angle often results in the antenna gain not being of the desired magnitude with a less pronounced adjustment of the tilting angle of the antenna gain or, conversely, in the level of the first secondary lobe above the primary lobe proving to be too great when optimising the antenna gain when tilting the primary lobe of the radiation diagram of the antenna (lowering the downtilt angle).

With the beam shaping by electronic means, the radiation diagram could now be changed in a relatively versatile manner, more specifically with free selection of the amplitudes and the phases. However, in particular in base station antennas for a mobile communications system, efficiency and price may be key factors. For this reason, mechanical phase shifters are generally often used for such antenna systems to adjust the downtilt angle differently. These mechanical phase shifters can directly extend the line length in a feed line ("Posaunen" principle, in which the entire line path can be reduced or increased by moving a line path). It is also possible to change the diffusion rate of the electromagnetic wave over a line path, for example by inserting a dielectric material in the region of the line path and thus changing the electrical conditions, or else a movable or displaceable coupling point can be used which can be displaced along a fixed line so as to shift the point of engagement. The possibilities for jointly changing the individual signals are considerably limited in this case, however.

Within the scope of the present invention a path is proposed which nevertheless offers the possibility of obtaining a much improved result in terms of solving the stated problem with minimal effort.

The principle of the invention is based on the fact that the radiators or radiator sub-groups arranged farthest away in a group antenna (for example in a group antenna the uppermost and lowermost radiators or radiator sub-groups) or controlled with the greatest phase difference are subjected to an additional phase shift, in other words are controlled by a disproportionately high phase shift in contrast to conventional systems.

In accordance with the invention, this does not occur with an additional means for generating an additional shift, but instead a correspondingly disproportionate phase shift with an additional phase shift proportion is generated by the same phase shifter which is also otherwise responsible in principle for beam pivoting.

Alternatively and in addition, in contrast to conventional systems, it is also possible to operate the radiators or radiator sub-groups which are arranged in a group antenna in the central region most densely in relation to one another (controlled by a differently adjustable phase position) using a disproportionately low phase shift with adjustment of a downtilt angle or an amended beam angle so that, in particular, the ratio of the phase position between the radiators operated with the greatest phase shift to the radiators operated with the lowest phase position change is characterised by a disproportionately large value.

This can be achieved when using a multiple differential phase shifter, as is known in principle for example from EP 1 208 614 B1, in that the outermost stripline, generally shaped in the arc of a circle, for feeding the farthest radiator or radiator sub-group lies further away from the concentric centre of a correspondingly pivotable, pointer-shaped tapping element and/or lies closer to the feedline centre, that is to say the pivot axis of the feedline arm at the next, arc-shaped stripline of this pivot axis.

In essence, this principle applies to an antenna system having an even or odd number of radiators and/or radiator sub-groups. An antenna system having an odd number of radiators or radiator groups is a system in which at least one radiator or at least one radiator group is provided which is fed with a bypassing of a differently adjustable phase shift system without changeable phase shift (normally arranged in the central region of the group antenna) so that no phase change is experienced at this radiator or this radiator group when the primary beam direction is pivoted (different adjustment of the downtilt angle).

An even radiator system is a system in which a group antenna having an even number of radiators or radiator sub-groups is provided (or, naturally, in this case a mixed system thereof) which are fed via the phase shift system, that is to say in particular do not comprise a central system which is controlled without phase shift.

In a supplementary or alternative embodiment of the invention it is also possible to position the pivot axis of the generally pointer-shaped, pivotable phase shift adjustment element closer to the striplines shaped as a segment or arc of a circle so that this pivot axis lies closer to the striplines than the centre point of the circular-segment-shaped striplines. As a result, a disproportionately large change in propagation time is generated by the farthest circular-segment-shaped stripline portion at the opposing connection points, and the phase shift change and therefore the propagation time change is reduced proportionately at the innermost circular-segment-shaped stripline portions, whereby the success according to the invention is achieved.

In particular, the invention is specifically based on the fact that at least one radiator or at least two pairs of radiators or radiator sub-groups fed via a differential phase shift are operated with an additional phase shift compared to the other radiators or radiator sub-groups in terms of the transmitting or receiving signal, which has a positive effect on an additional beam shaping within the meaning of the invention. The contribution of the additional phase shift is dependent on the adjustment of the beam pivoting. Owing to the fact that the most simple additional beam deformation is to be achieved, it is ensured that the size of the secondary lobe located above the primary lobe is smaller in the tilted state with increasingly advanced tilting of the primary lobe of a group antenna compared to a system not according to the invention (interference with adjacent cells is thus avoided) and/or that the antenna gain of this primary lobe is relatively greater in the case of a primary lobe oriented in the horizontal direction (that is to say with a tilting or pivoting angle which is not so pronounced) than with conventional antenna systems.

The example non-limiting technology herein provides illustrative non-limiting advantages and features at least some of which are:

with an antenna array having an even number of radiator arrangements (1) and/or without a phase-neutrally controlled central radiator arrangement (1*x*), the following inequality is satisfied:

$$Ph_N: Ph_1 \geq S_N:S_1+0.4$$

with an odd number of radiator arrangements (1) and/or a phase-neutrally controlled central radiator arrangement (1*x*), the following inequality applies:

$$Ph_N: Ph_1 \geq S_N:S_1+k$$

in which k is 0.25 or preferably 0.30 and in particular 0.40 with an even number of radiator arrangements (1) and/or without a phase-neutrally controlled central radiator arrangement (1*x*), the following inequality applies:

$$Ph_N: Ph_1 \geq S_N:S_1+k$$

in which k is 0.5 or preferably 0.6 and in particular 0.8, with an odd number of radiator arrangements (1) and/or a phase-neutrally controlled central radiator arrangement (1*x*), the following inequality applies:

$$Ph_N: Ph_1 \geq n+m$$

in which n is a natural number 2, 3, 4 . . . N, corresponding to the number of radiator arrangements (1) provided on an antenna array half above or below the centre (Z) of the antenna array, and m corresponds to 2.0 or in particular 1.5 or 1.0, with an even number of radiator arrangements (1) and/or without a phase-neutral centre feed of a radiator arrangement (1*x*) close to the centre, the following inequality applies:

$$Ph_N:Ph_1 \leq 2n+m$$

in which n is a natural number 2, 3, 4 . . . N, corresponding to the number of radiator arrangements (1) provided on an antenna array half above or below the centre (Z) of the antenna array, and m corresponds to 3.0 or preferably 2.5 or preferably 2.0.

The example non-limiting technology herein provides illustrative non-limiting advantages and features some of which are:

with an antenna array having an even number of radiator arrangements (1) and/or without a phase-neutrally controlled central radiator arrangement (1*x*), the following inequality is satisfied:

$$Ph_N: Ph_1 > S_N:S_1+0.4$$

the group antenna consists of an even number of radiator arrangements (1) and/or does not comprise a phase-neutrally controlled radiator arrangement (1*x*) provided in the region of the centre (Z) of the group antenna, the group antenna is equipped in particular with an odd number of radiator arrangements (1) having a phase-neutrally controlled radiator arrangement (1*x*) arranged close to the centre or in the centre (Z) of the group antenna, with an odd number of radiator arrangements (1) and/or a phase-neutrally controlled central radiator arrangement (1*x*), the following inequality is satisfied:

$$Ph_N: Ph_1 > S_N:S_1+k$$

in which k is 0.25 or preferably 0.30 and in particular 0.40, with an even number of radiator arrangements (1) and/or without a phase-neutrally controlled central radiator arrangement (1*x*), the following inequality applies:

$$Ph_N: Ph_1 > S_N:S_1+k$$

in which k is 0.5 or preferably 0.6 and in particular 0.8, with an odd number of radiator arrangements (1) and/or a phase-neutrally controlled central radiator arrangement (1*x*), the following inequality applies:

$$Ph_N: Ph_1 < n+m$$

in which n is a natural number 2, 3, 4 . . . N, corresponding to the number of radiator arrangements (1) provided on an antenna array half above or below the centre (Z) of the antenna array, and m corresponds to 2.0 or in particular 1.5 or 1.0, with an even number of radiator arrangements (1) and/or without a phase-neutral centre feed of a radiator arrangement (1*x*) close to the centre, the following inequality applies:

$$Ph_N: Ph_1 < 2n+m$$

in which n is a natural number 2, 3, 4 . . . N, corresponding to the number of radiator arrangements (1) provided on an antenna array half above or below the centre (Z) of the antenna array, and m corresponds to 3.0 or preferably 2.5 or preferably 2.0, at least the stripline portion (11, 11*a*) having the largest radius (RN) is provided with a dielectric, which is not air, on one or preferably on both sides, which dielectric is provided with constant or different or varying thickness over the entire length of the stripline portion or over one or over more partial lengths.

BRIEF DESCRIPTION OF THE DRAWINGS

The invention will be described in greater detail hereinafter with reference to embodiments. In the drawings, in detail:

FIGS. 4*a* to 4*d*: show four examples with a phase shifter assembly comprising two circular-segment-shaped stripline arcs, wherein FIG. 4*a* shows a phase shifter assembly according to the prior art and FIGS. 4*b* to 4*d* show a phase shifter assembly according to the invention;

FIGS. 5*a* to 5*d*: show four examples with a phase shifter assembly comprising three circular-segment-shaped stripline arcs, wherein FIG. 5*a* shows a phase shifter assembly according to the prior art and FIGS. 5*b* to 5*d* show a phase shifter assembly according to the invention;

FIGS. 6*a* to 6*d*: show four examples with a phase shifter assembly comprising four circular-segment-shaped stripline arcs, wherein FIG. 6*a* shows a phase shifter assembly according to the prior art and FIGS. 6*b* to 6*d* show a phase shifter assembly according to the invention;

FIGS. 8*a* to 8*d*: show four examples with a phase shifter assembly comprising two circular-segment-shaped stripline arcs, wherein FIG. 8*a* shows a phase shifter assembly according to the prior art and FIGS. 8*b* to 8*d* show a phase shifter assembly according to the invention, wherein the phase shifter assemblies shown feed an antenna with an odd number of radiator arrangements in accordance with the illustration according to FIG. 7*a*;

FIGS. 9*a* to 9*d*: show four examples with a phase shifter assembly comprising three circular-segment-shaped arcs, wherein FIG. 9*a* shows a phase shifter assembly according to the prior art and FIGS. 9*b* to 9*d* show a phase shifter assembly according to the invention, wherein the phase shifter assemblies shown feed an antenna with an odd number of radiator arrangements in accordance with the illustration according to FIG. 7*a;*

FIGS. 10*a* to 10*d*: show four examples with a phase shifter assembly comprising four circular-segment-shaped arcs, wherein FIG. 10*a* shows a phase shifter assembly according to the prior art and FIGS. 10*b* to 10*d* show a phase shifter assembly according to the invention, wherein the phase shifter assemblies shown feed an antenna with an odd number of radiator arrangements in accordance with the illustration according to FIG. 7*a;*

DETAILED DESCRIPTION

Figure 1:
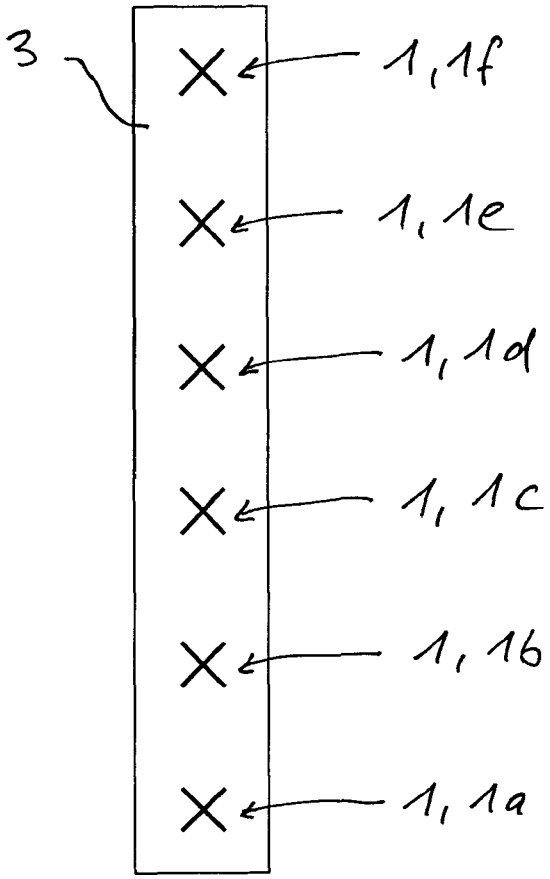
FIG. 1: is a schematic front view of a group antenna comprising, for example, six radiators or radiator sub-groups arranged above one another in the vertical direction.

FIG. 1 is a schematic front view of a group antenna which comprises a plurality of radiators 1 in front of a reflector 3. In the embodiment shown, the group antenna comprises six dual polarised radiators or radiator arrangements 1*a* to 1*f*.

The radiators may consist of different radiators or radiator types, of dipole radiators, crossed dipoles, "vector dipoles" (for example known from WO 00/39894 A1), patch radiators or the like. The antenna may be a mono-band antenna, a dual-band antenna or a multi-band antenna which transmits and/or receives in three or more frequency bands. The antenna may also be a single polarised or dual polarised antenna. In this respect, reference is made to known solutions.

For example, an antenna shown schematically with reference to FIG. 1 may be used in the base station of a mobile communications system.

In accordance with the embodiment described, mechanically actuatable differential phase shifters as are known in principle from EP 1 208 614 B1 are used to adjust, in different ways, a pivoting angle in general or a tilting angle in particular, that is to say the downtilt angle, in relation to the horizontal plane. Reference is made to this prior publication with regard to the detailed construction.

Figure 2A:
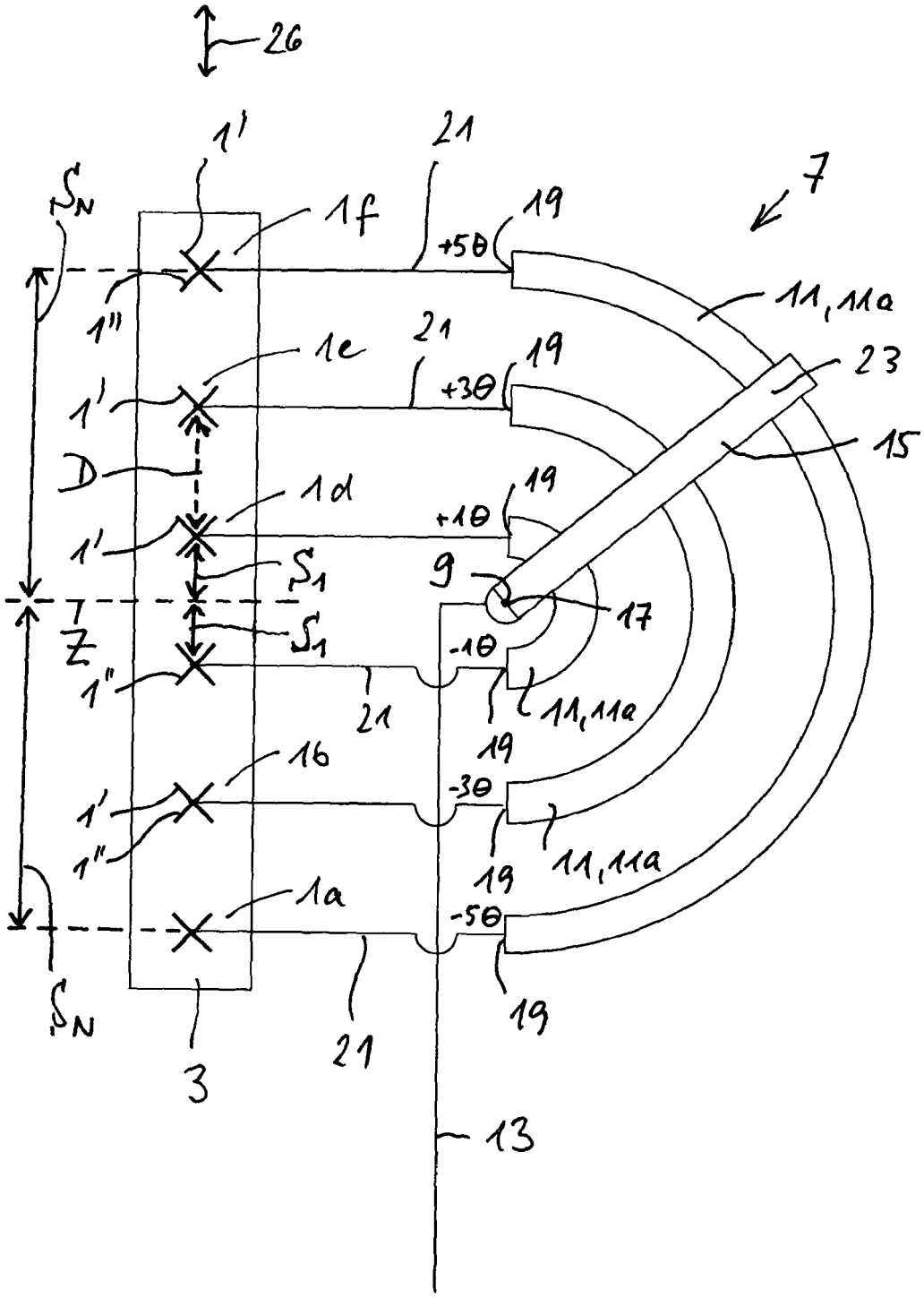
FIG. 2*a*: shows a phase shifter assembly, which is known in principle, for controlling a group antenna shown in FIG. 1.

FIG. 2*a* shows such a phase shifter assembly known from the aforementioned prior publication EP 1 208 614 B1, with which for example an antenna shown in FIG. 1 with six radiators or radiator sub-groups 1 arranged above one another in the vertical direction can be operated with a different tilting angle. This is a group antenna in which an even number of radiators or radiator groups can be controlled. In other words, it is a group antenna which has no radiator or radiator group (generally in the centre) operated without a change in phase position.

FIG. 2*a* shows a previously known phase shifter arrangement or assembly 7 which comprises three circular-segment-shaped line portions 11, generally "stripline portions 11*a*" arranged concentrically about a centre point 9. A feed line 13 leads to the central feed point 9 of the tapping element 15, wherein the feed point 9 is provided in the region of the pivot axis 17 of the tapping element 15. The pointer-shaped tapping element 15 can be moved about its pivot axis 17 over the circular-segment-shaped concentrically arranged line portions 11. The feed signal is then transmitted via capacitive couplings between the tapping element 15 and the line portions 11, wherein in each case a connection line 21 on the opposing ports 19 at the end of the line portions 11 leads to the radiators or radiator groups 1.

Depending on the position of the tapping element which, for example, is automatically pivotable via a remotely controllable motor means, paths of different length are produced from the respective point of engagement or coupling 23 (that is to say the respective area of engagement or coupling 23) between the tapping element 15 and the coupled portion of the circular-segment-shaped striplines 11a and the ports 19 opposite the stripline portions 11, 11 a, whereby if the tapping element 15 is moved the propagation time of the radiators fed on one side of the tapping element 15 is reduced and the propagation time of the radiators connected on the other side is extended or delayed in accordance with the path length. If the tapping element 15 is located in its neutral centre position (in the horizontal direction in FIG. 2*a*), the opposing ports 19 of a respective stripline-shaped arc 11, 11*a* have the same phase position. By contrast, in the embodiment shown the tapping element 15 can be moved into the maximum vertical upper end position or the maximum lower end position extending in the vertical direction, wherein the maximum phase shift between these two end or extreme positions can be produced using the phase shifter means.

As mentioned, in FIG. 2*a* a corresponding connection line 21 is indicated between the ports 19 at the opposing port ends of the circular-segment-shaped stripline portions 11 and a respective radiator or a radiator group 1, said connection line being used to feed a radiator 1 suitable for a polarisation plane, for example for the dipole or dipole-like radiators 1', oriented at −45°, of the dipole radiators 1 which for example are cross-shaped or dipole-square-like or vector-dipole-like. A corresponding second phase shifter assembly 7 for feeding the second polarisation plane of, for example +45° therefore has to be provided, that is to say to feed the radiators 1" which are operated in a corresponding polarisation plane rotated through 90°. For the sake of simplicity, this has not been included in FIG. 2*a*. In principle, all suitable radiators or radiator types can be used, for example patch radiators, slot radiators, etc. In this respect there are no limitations.

The radiators 1, 1' and 1" illustrated in FIG. 1 and FIG. 2*a* are normally arranged at equal distances D from one another in the direction of assembly according to the arrow 26, that is to say in an equidistant arrangement to one another. However, these distances D can also by all means vary between some radiators arranged side by side or above one another in the direction of assembly 26, that is to say they do not necessary always have to have the same fixed distance D from one another.

Furthermore, in FIG. 2*a* the distance $S_n$ between the phase-neutral centre position Z (that is to say the centre of the antenna) and the farthest upper and farthest lower radiators 1*f* and 1*a* therefrom is shown, as is the distance $S_1$, which is the distance between the phase-neutral centre position (centre) Z and the radiators 1 provided above and below the neutral centre position Z closest to said centre Z.

Figure 2B:
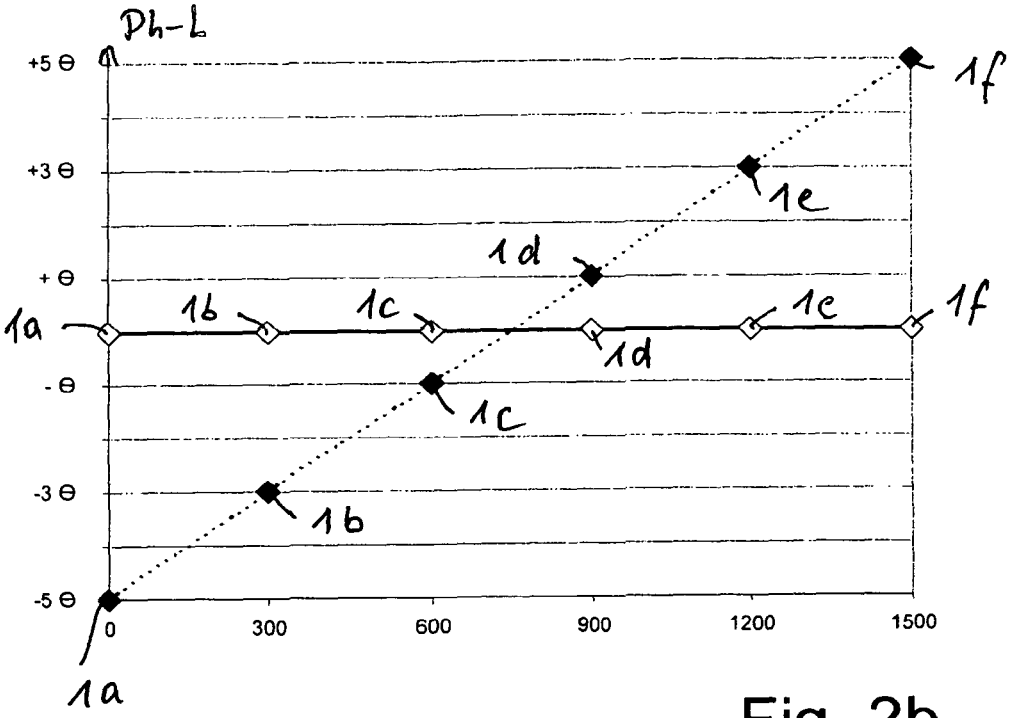
FIG. 2*b*: is a diagram illustrating the phase positions at the ports of the fed radiators or radiator arrangements of a group antenna according to FIG. 1 or FIG. 2*a* with two different phase shifter adjustments.

Such a group antenna is thus normally operated with a phase shifter assembly according to FIG. 2*a*, which comprises circular-segment-shaped line portions 11 arranged concentrically with one another, in particular striplines 11*a* of which the radii $R_N$:$R_2$:$R_1$ are arranged at a ratio to one another of 5:3:1, more specifically based on the centre 17 of the circular-segment-shaped striplines 11*a*, which simultaneously with the pivot axis 17 of the phase shifts is arranged at a fixed ratio of, for example, $\phi$, $3\phi$, $5\phi$, etc. so that, as shown in FIG. 2*b* for example, phase positions of +5Θ, +3Θ, +1Θ, −1Θ, −3Θ, −5Θ can be achieved, wherein Θ is a phase angle produced by the position of the tapping element and by the associated propagation time extension or propagation time delay.

The structure and operating principle of the phase shifter and of the entire antenna arrangement is such that, for example, a feed signal is guided to the central feed point 9 of the tapping element 15 and, from here, spreads out further in the radial direction over the tapping element 15 and the areas of engagement and coupling 23 and then over the arc-shaped stripline portions. Some of the signal is coupled out on the innermost arcs, some is coupled out on the second arc, etc. Since this diffusion requires exactly the same amount of time as is needed for diffusion over an arc-shaped stripline, these arcs are also fed with different phases. If the tapping element 15 is located in the centre position, the propagation times over the two line portions of an arc are the same. However, if the arcs 11, 11*a* have different propagation times in accordance with their radii, this means that the inner arc also again has the shortest propagation time in this regard. Overall, in the centre position phase differences at the ports of the different arcs of 200° for example can therefore be established. If the group antenna then has a beam pivot of 0° in this centre position of the phase shifter, the phases at the radiators must be brought to the same value. This is achieved by lines of different length between the phase shifter ports 19 and the radiators 1*a* to 1*f*. In mobile communications systems however, merely a beam tilt in the downwards direction is normally required, that is to say the adjustment range should not be +5° . . . −5° for example, but 0° . . . −10° for example. In this case, the line lengths 21 to the radiators 1*a* to 1*f* are thus selected in such a way that the group antenna has a beam tilt of 5° in the centre position of the phase shifter (that is to say in the centre position of the tapping element 15). This applies equally to identical phases at the radiators if the phase shifter is located in the extreme position "minimal beam tilt". Since part of the line naturally always signifies a phase delay, the last gap is standardised to the greatest value, that is to say all other radiators require a correspondingly longer feed line.

| Radiator | Phase shifter base phase (based on innermost arc) | Desired phase at the radiator in centre position of the phase shifter | Phase difference for feed line | Phase difference for feed line (<0) |
|---|---|---|---|---|
| a | −400° | −62.5° | 337.5° | −125° |
| b | −200° | −37.5° | 162.5° | −300° |
| c | 0 | −12.5° | −12.5° | −475° |
| d | 0 | 12.5° | 12.5° | −450° |
| e | −200° | 37.5° | 237.5° | −225° |
| f | −400° | 62.5° | 462.5° | 0 |

Even at this juncture it is noted that the invention described hereinafter in detail is basically independent of constant propagation times or phases at the individual radiators. This applies not only in terms of the shift of the pivot angle range (for example from +5° to −5° to a pivot range of 0° to −10°, etc., as illustrated above), but also in terms of further measures for forming a graph, such as a zero-filling below the primary lobe beam direction. The variable phase shifts of the phase shifter based in the positions of the radiators or radiator groups are relevant to the invention.

FIG. 2*b* shows the phases of the radiators 1*a* to 1*f* for an example as described above. FIG. 2*b* shows the phase positions Ph-L at the radiator ports 1*a* to 1*f*, more specifically for two different settings of the tapping element 15. One data series (characterised by the light points) describes the phase positions at the radiator ports when the tapping element 15 is located in one of its extreme positions. The second data series (dark points) relates to the phase position Ph-L at the radiator ports 1*a* to if when the tapping element 15 is moved into its opposite extreme position, in which the lowermost radiator 1*a* experiences the greatest phase delay and the uppermost radiator if experiences the smallest phase delay. For this purpose the corresponding measurement points for the radiators 1a to if are plotted from left to right in the graph according to FIG. 2*b*.

In other words, this example is selected in such a way that when the tapping element 15 is moved into one of its extreme positions (light measurement points in FIG. 2*b*), all radiators radiate at the same phase, wherein if the tapping element 15 is moved into the other extreme position, a maximum phase difference and therefore a maximum downtilt angle can be set.

Figure 2C:
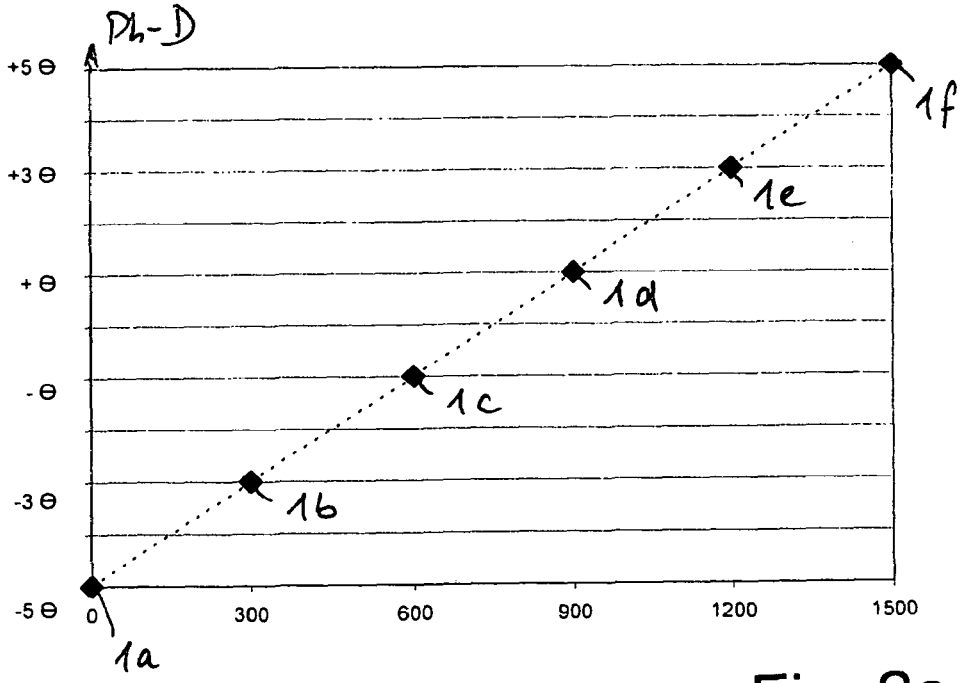
FIG. 2*c*: is a diagram derived from FIG. 2*b* for illustrating the phase shifts which occur for the individual radiators from the two adjusted values of the phase shifter according to FIG. 2*b;*

By contrast, FIG. 2*c* shows the differences Ph-D between the respective two phase values for the individual radiators 1*a* to 1*f*. The phase difference (as shown in FIG. 2*c*), that is to say the phase shift, which is generated by moving the tapping element 15, could also be ascertained directly by measuring the phase of a relevant radiator, for example at minimum beam tilt, and by subsequent measurement of the phase of the radiator at maximum beam tilt. Conventional measuring devices offer the possibility of determining the first value as a reference value for the subsequent measurement. The subsequent calculation of the difference between the phase values would be omitted in this case.

Since the values indicated in the graph according to FIG. 2*c* are independent of the cable length between the phase shifter ports 19 and the radiators 1, the phase shifter ports in particular also have the same values.

It is further noted that in FIGS. 2*b* and 2*c* the positions of the individual radiators or radiator groups 1*a* to 1*f* are illustrated on the x axis, and are each arranged at a vertical distance of, for example, 300 mm from one another. The distances between the radiators provided on the x axis in FIG. 2*b* in millimetres are thus given from the lowermost radiator 1*a* in FIG. 2*a* to the uppermost radiator 1*f*. It can thus be seen from FIG. 2*c* that equal phase position changes between the individual radiators can be produced with equal distances between the radiators owing to a corresponding phase shifter assembly. The middle or centre Z of the group antennas is defined by the phase-neutral centre position which thus does not or would not experience any change in phase position if a change in phase position were adjusted (adjustment of a pivot or downtilt angle).

Before the embodiment according to the invention is now detailed with reference to the subsequent figures, it is noted that the phase shifter assembly according to the invention is preferably used for an antenna or antenna arrangement (antenna group), in which the individual radiators or radiator groups, that is to say the radiator arrangement 1, are arranged at the same distance D from one another (that is to say, for example, the centres of the corresponding radiator arrangement are arranged at the same distance D from one another), wherein these distances may also vary in part. The individual distances D between the radiators, radiator arrangements or radiator groups should be equal or should deviate from one another by no more than 15% or by less than 15%. The distances D should preferably be equal or should deviate from another by less than 10%, in particular by less than 8%, 6%, 5%, 4%, 3%, 2% and in particular by less than 1%.

Figure 3A:
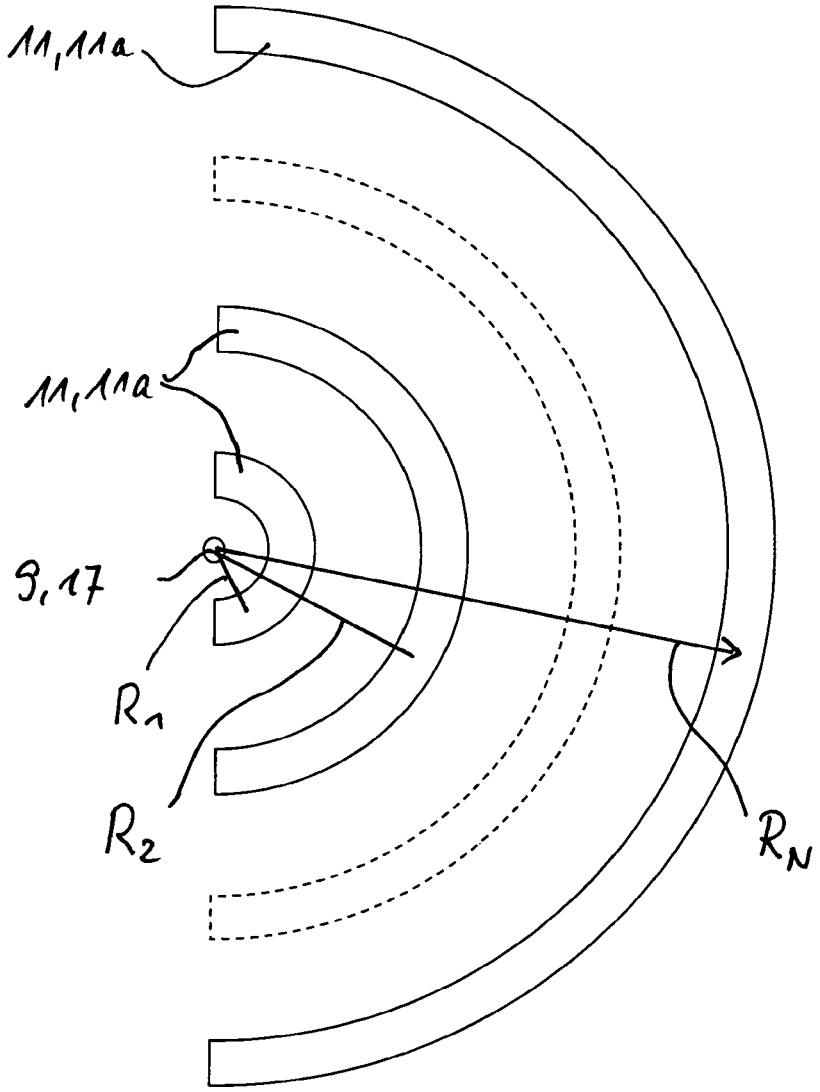
FIG. 3*a*: shows a first embodiment according to the invention of a phase shifter assembly for controlling a group antenna having an even number of radiator arrangements which include radiators and/or radiator sub-groups, that is to say in particular a group antenna in which no radiators or radiator sub-groups are adjusted without a phase shift when the downtilt angle is changed.

By contrast, the embodiment according to FIG. 3*a* now shows an embodiment according to the invention in which the distance, that is to say the radius $R_N$ from the outermost stripline portion 11*a* to the centre 9 or the pivot axis coincident therewith and the feed point 17 of the tapping element 15 and, above all, to the innermost concentrically arranged stripline portion 11*a* is further than that in the embodiment according to the prior art, as shown in FIG. 2*a*. Whilst the radii $R_N$:$R_2$:$R_1$ at the stripline portions 11*a* in conventional phase shifters, as is shown with reference to FIG. 2*a*, are arranged side by side at a ratio of 5:3:1 (calculated from the outside inwards towards the centre), in the embodiment according to the invention this ratio is selected for example to be 7:3:1 according to FIG. 3*a* (wherein the position of the outermost stripline portion in the case of a conventional design of the phase shifter, as shown in FIG. 2*a*, is shown as a dashed line in FIG. 3*a*).

Although, in principle, the solution according to the invention is also possible by connecting and coupling (mechanical assembly, etc.) a plurality of separate phase shifters, in accordance with the invention a single phase shifter assembly is preferably used which, in accordance with the following embodiments, comprises two or more stripline arcs in order to feed a corresponding number of radiators or radiator groups. More preferably, a differential phase shifter or a differential phase shifter assembly is used in which, by moving the tapping element, the path length to the ports 19 over the various stripline arcs is reduced on one side of the stripline portions and the path length to the opposite ports 19 is increased by a corresponding path portion, in other words in one direction the propagation time is shortened, and in the other direction the propagation time is accordingly lengthened, whereby the different phase shift or phase adjustment is implemented.

With regard to definition of the selected length of the radii $R_N$, $R_2$ and $R_1$ (also in the following practical examples), it is to be noted that each of the arc-shaped stripline portions 11 can ultimately be defined by an inner radius, an outer radius and a central radius owing to a width extending in the radial direction. For the explanation of the invention, the "central radius" is always assumed to be that which comes to lies in the centre of the respective circular-segment- and strip-shaped line portion 11. This central radius is decisive for the length of the arc and therefore for the phase shift.

Figure 3B:
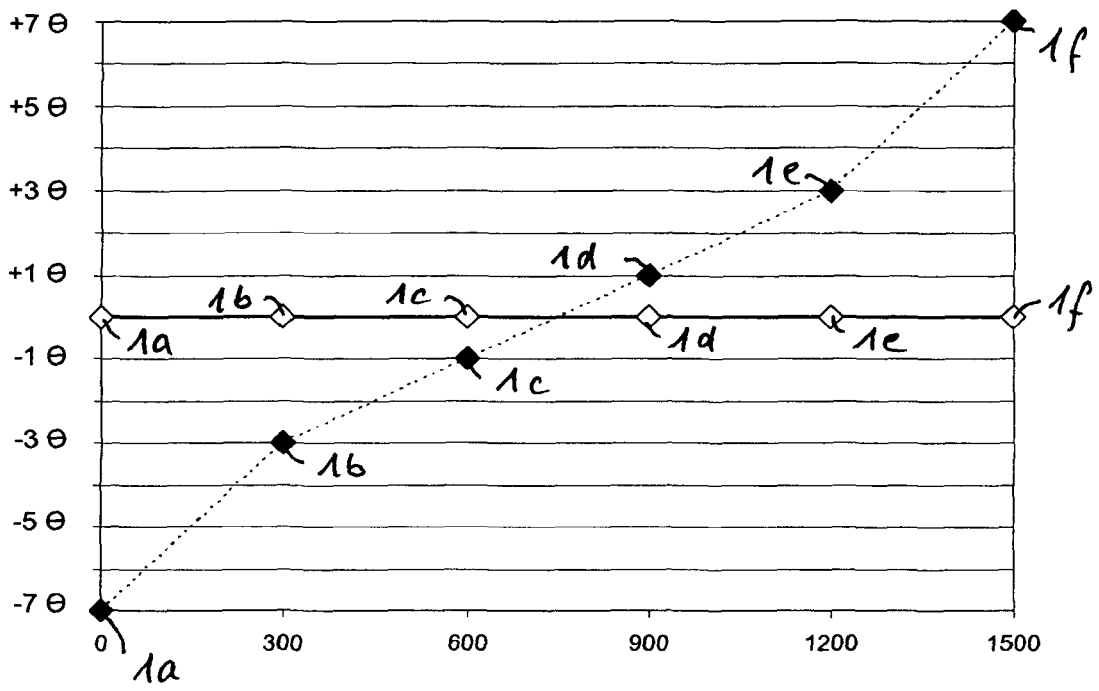
FIG. 3*b*: is a diagram corresponding to FIG. 2*b* for a phase shifter assembly according to the invention in accordance with FIG. 3*a;*
Figure 3C:
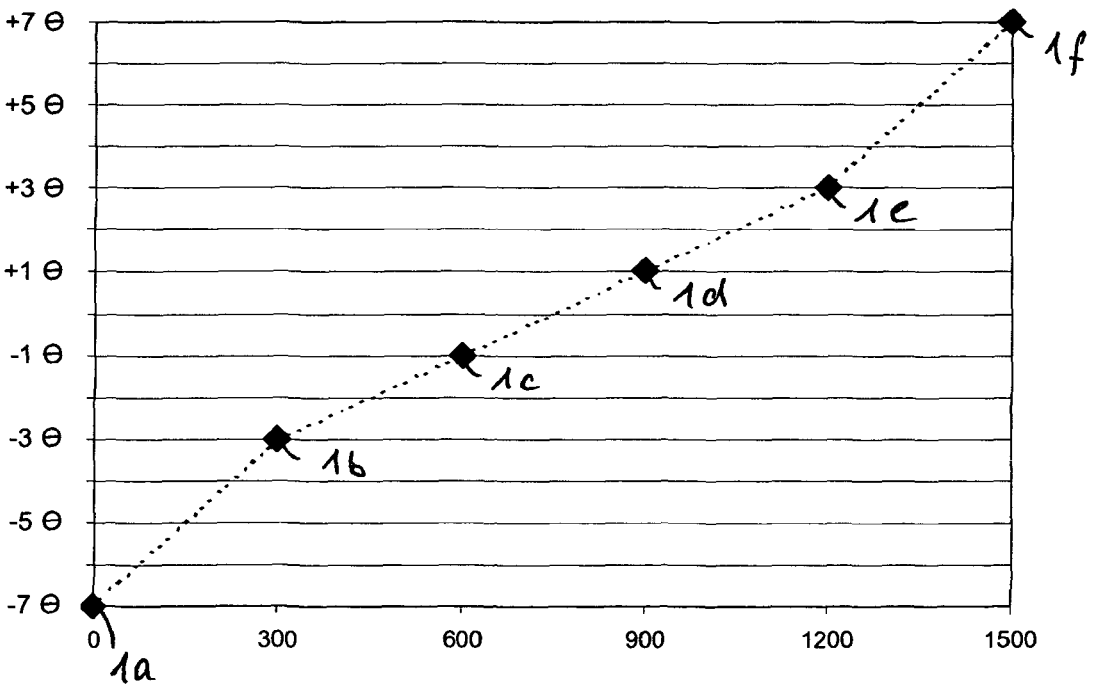
FIG. 3*c*: is a diagram corresponding to FIG. 2*c* for a phase shifter assembly according to the invention in accordance with FIG. 3*a;*

The corresponding maximum achievable phase differences with an otherwise unchanged group antenna are represented with reference to FIG. 3*c*, wherein in FIG. 3*b* the disproportionate change in phase position can be seen in terms of the two furthest radiators 1*a* and 1*f*.

Generally, this ratio should be selected so that the radius ratio $R_N$:$R_1$ between the outermost nth stripline portion and the innermost stripline portion (which thus lies closest to the centre point 9 and therefore to the feed point 17 of the tapping element 15), controlling the radiators or radiator sub-groups, has a value of $$>5.4:1$$

with use of three stripline portions 11*a* without phase-neutral centre control (that is to say with an even group antenna with an even number of radiators and/or radiator groups).

A systematic overview of the solutions according to the invention in contrast to the prior art will be given hereinafter, wherein different examples will be discussed. Examples are first shown, in which a group antenna is fed via a phase shifter arrangement in which the antenna group has an even number of radiators or radiator sub-groups. In other words, a group antenna is used which has no central radiator arrangement or radiator group, which is operated without phase shifting, if the radiators offset from the centre are controlled by a phase position which can be adjusted in different manners.

Figure 4A:
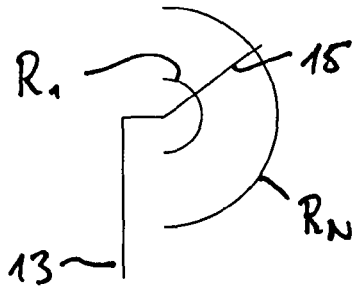
Figure 4B:
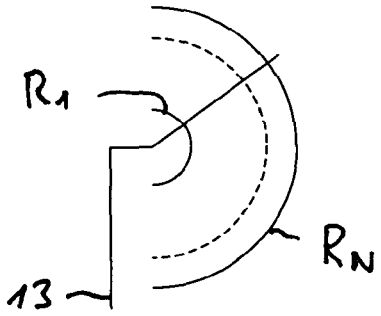
Figure 4C:
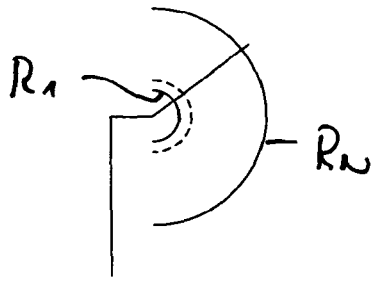
Figure 4D:
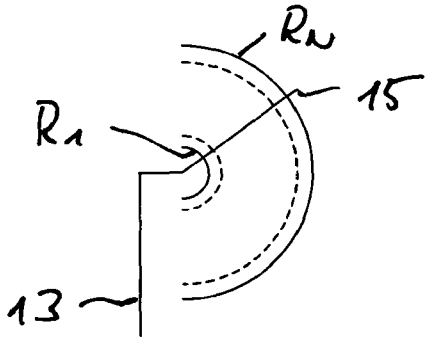

Example 1 with Two Concentric Striplines:

With reference to FIG. 4*a*, a solution according to the prior art is shown and a different solution according to the invention is shown in FIGS. 4*b* to 4*d*. In the example according to the prior art which comprises two arcs in accordance with FIG. 4*a*, the ratio of the radius $R_N$, that is to say the outermost radius of the circular-segment-shaped stripline 11*a*, to the inner radius $R_1$ is 3:1.

An increase in antenna gain with a horizontal orientation of the main lobe and a reduction and attenuation of the first side lobe arranged above the main lobe with greater tilting of the main lobe can be achieved if the radius of the outer stripline is increased (shown in FIG. 4*b*), or if the inner radius $R_1$ of the innermost circular-segment-shaped stripline is reduced (shown in FIG. 4*c*), or both the outer radius $R_N$ of the outer stripline is increased and the inner radius $R_1$ of the innermost stripline is simultaneously reduced, The position of the circular-segment-shaped and concentric stripline portions 11*a* is indicated in FIGS. 4*b* to 4*d* (as in all further figures) as a dashed line in the event of positioning as in the prior art according to FIG. 4*a*. The dashed circular segment indicated in FIG. 4*b* thus corresponds to each position in which the outermost circular-segment-shaped stripline in FIG. 4*a* is arranged with the radius $R_N$.

In the first solution according to the invention in accordance with FIG. 4*b*, the radius $R_N$ of the outermost stripline portion has been increased so that a ratio of the radius $R_N$ to the inner radius $R_1$ of 3.8:1 for example is given.

In the embodiment according to FIG. 4*c*, the innermost radius of the inner stripline has been reduced so that a ratio of $R_N$:$R_1$ of 3:0.7 is given, that is to say equivalent to 4.29:1

In FIG. 4*d* the outer radius $R_N$ has been increased compared to the solution according to FIG. 4*a* known from the prior art and, at the same time, the inner radius $R_1$ has been reduced. In this case a ratio of, for example $R_N$:$R_1$ of 3.4:0.9 or equivalent to 3.78:1 is given.

Generally, the ratio between the outermost and innermost radii $R_N$:$R_1$ should be greater than 3.4 and preferably greater than 3.5 or 3.6 or 3.8. The maximum value of this ratio is ≤7, preferably ≤6.5 or ≤6.

In principle, in the example explained according to FIG. 4*b* even the radius of the innermost stripline portion in the centre could also be increased (that is to say not remain unchanged or else reduced) provided only the ratio of $R_N$:$R_1$ remains greater than 3.4:1. The ratio of the radii is thus decisive since the desired disproportionate phase shift for the furthest radiators is thus set or adjusted differently in a specific ratio of the phase shift of the radiators closest to the centre of the antenna compared to conventional solutions according to the prior art so as to achieve a maximum antenna gain and also to reduce, above all, the level of the first side lobe located above the main lobe when setting a different downtilt angle.

Example with Use of Three Stripline Arcs:

With reference to FIGS. 5*a* to 5*d*, an example of a group antenna having six radiators 1 or radiator sub-groups 1 arranged above one another is shown, that is to say an even number of radiators or radiator sub-groups which are not thus fed via a central feed independent of phase.

Figure 5A:
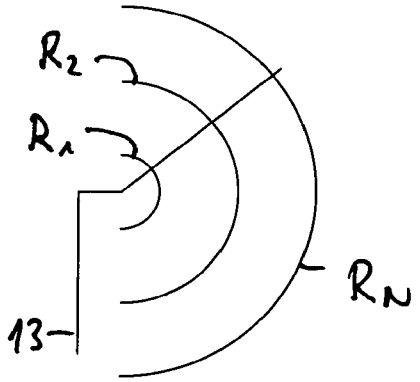
Figure 5B:
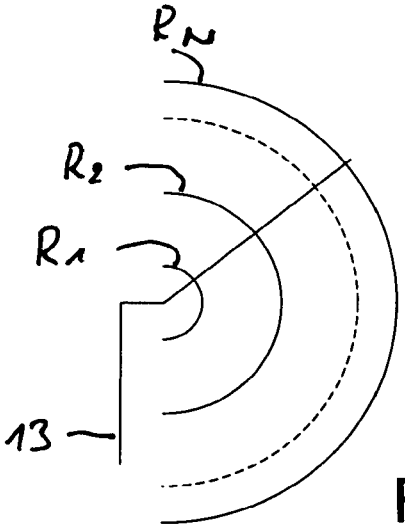
Figure 5C:
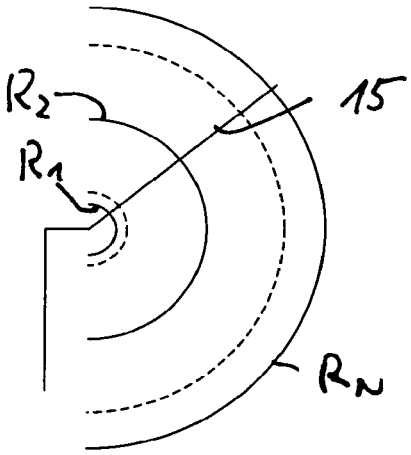
Figure 5D:
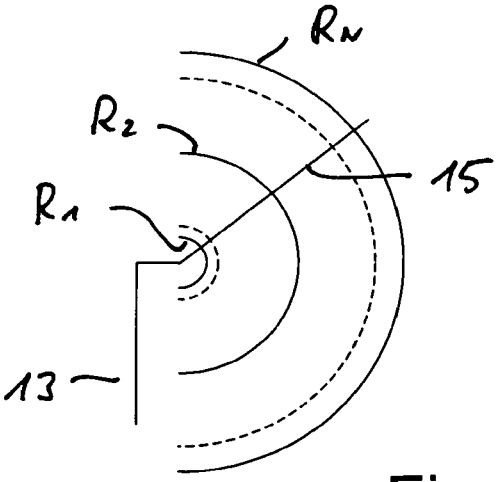

FIG. 5*a* again shows the embodiment according to the prior art ($R_N$:$R_2$:$R_1$=5:3:1) and FIGS. 5*b* to 5*d* show variations in which firstly the outermost radius $R_N$ of the outermost stripline portion has been increased, in FIG. 5*c* the radius $R_1$ of the innermost stripline portion has been reduced and in FIG. 5*d* the outermost radius $R_N$ has been increased and the innermost radius $R_1$ has been reduced. The ratio between the radius $R_N$ of the outermost circular-segment-shaped stripline portion 11*a* and the innermost (that is to say closest to the centre point 9) radius $R_1$ should be greater than 5.4:1 in this embodiment, and in particular should be greater than 5.5 or 5.6 or should be 5.6:1. Maximum values are 9, preferably ≤8.5 or ≤8. The corresponding data are reproduced in the enclosed accompanying tables.

Figure 6A:
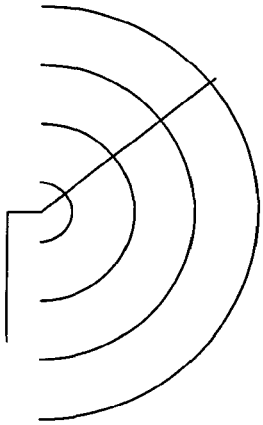
Figure 6B:
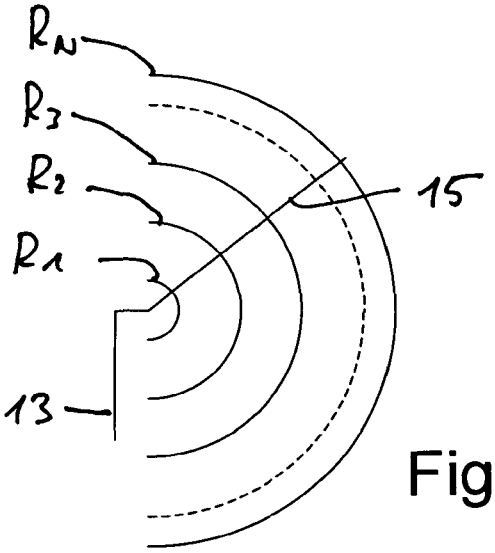
Figure 6C:
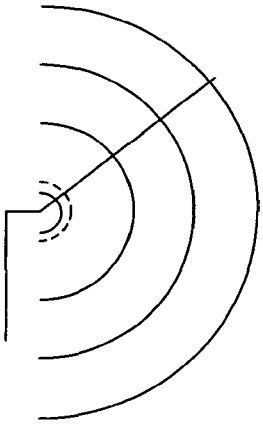
Figure 6D:
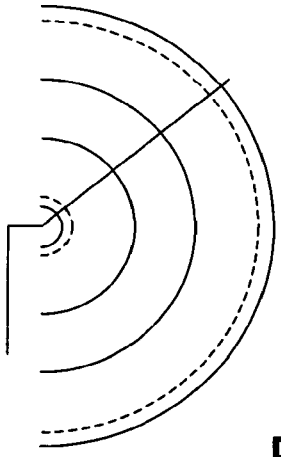

Example with Four Stripline Arcs:

FIGS. 6*a* to 6*d* show the corresponding ratios in terms of the feed of a maximum of eight radiators or radiator sub-groups by means of four concentric circular-segment-shaped stripline arcs, wherein FIG. 6*a* again shows the solution according to the prior art ($R_N$:$R_3$:$R_2$:$R_1$=7:5:3:1) and the other figures describe the solutions according to the invention. Again, in FIGS. 6*b* to 6*d* the position of the stripline portions according to the prior art is shown by a dashed line, wherein in FIG. 6*b* the outer radius has been increased, in FIG. 6*c* the innermost radius has been decreased and in FIG. 6*d* the outer radius has been increased and the innermost radius has simultaneously been reduced. The corresponding data are reproduced in the enclosed accompanying tables.

In this embodiment too, the ratio of the radius of the outermost stripline arc to the innermost stripline arc should be a value of 7.4:1 or, more preferably, a value of 7.5 or 7.6 or 7.8:1 or more. The maximum ratio of the outermost to innermost radius should generally not exceed 10, and should preferably be 10.5 or 10.

Generally, the ratios for a phase shifter assembly can be described in such a way that the ratio of the outermost radius $R_N$:R, is to be selected so that the following inequality applies:

$$R_N:R_1 \geq 2n-0.6$$

where n is a natural number 2, 3, 4 . . . N, and n corresponds to the number of circular-segment-shaped line portions used in the phase shifter assembly, that is to say stripline portions 11*a*.

In the embodiments illustrated having more than two stripline arcs, the circular-segment-shaped stripline portions arranged between the innermost and outermost stripline arcs remain unchanged in their position, as in the prior art. These central stripline portions may also have a slightly greater or smaller radius as necessary. However, the changes caused thereby are only of marginal significance. The enlargements and reductions of the radius of the stripline portion having the greatest and/or smallest radius are significant.

Figure 7A:
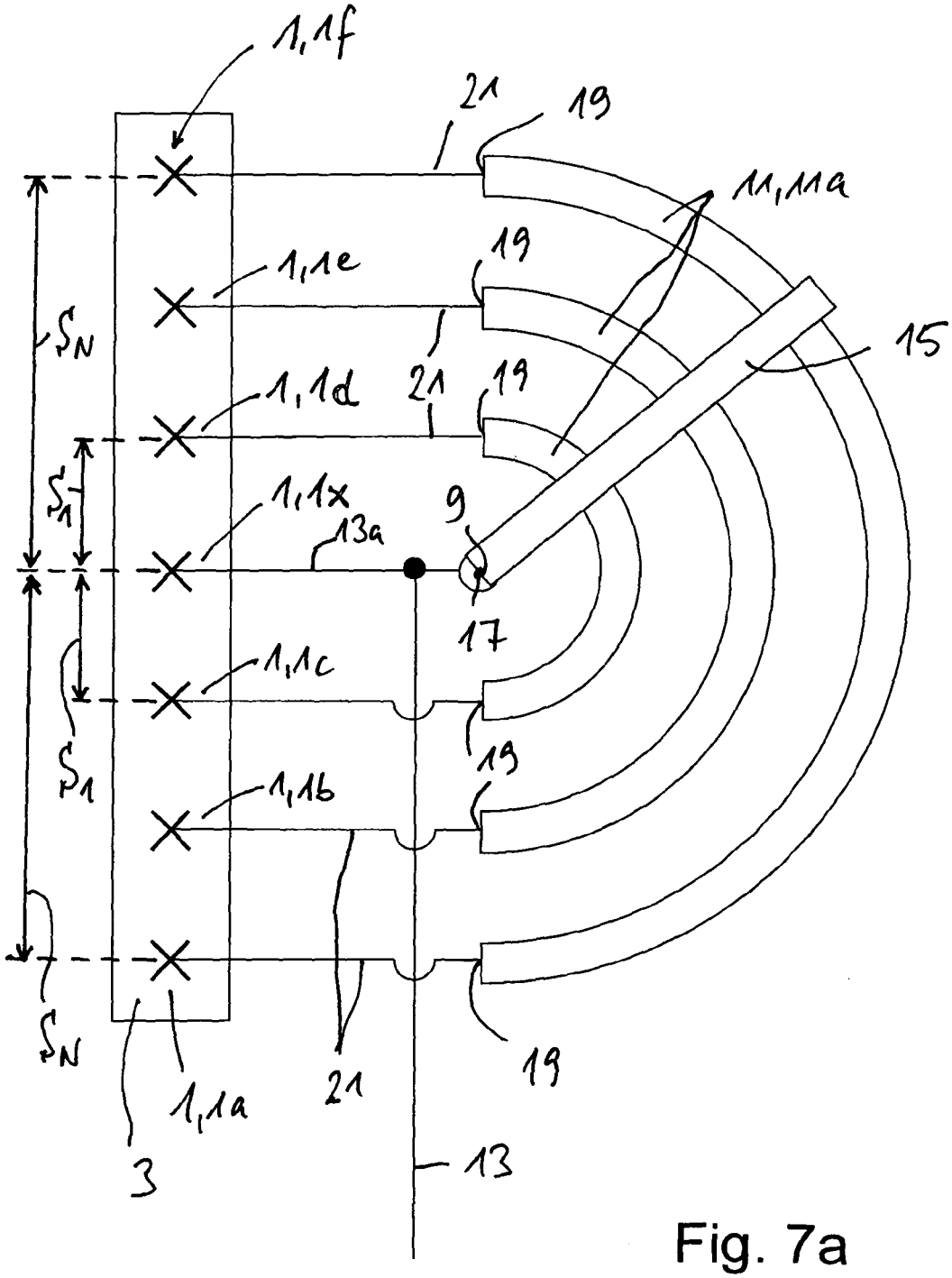
FIG. 7*a*: shows an example corresponding to FIG. 2*a* of a previously known phase shifter assembly belonging to the prior art for controlling a corresponding group antenna, which assembly comprises seven radiator arrangements arranged above one another in the vertical direction which may each consist of radiators and/or radiator groups, wherein a central radiator arrangement is controlled in a phase-neutral manner in the centre of the group antenna, that is to say no change to the phase position is experienced with a corresponding movement of the phase shifter assembly.

For example, if an antenna array having an odd number of radiators or radiator sub-groups is to be fed, a phase shifter assembly can be used as is shown in principle with reference to FIG. 7*a*, in which a central radiator or radiator sub-group 1*x* is thus always fed without phase shift. In accordance with the prior art, a phase shifter assembly is thus produced in which the different changes to phase position indicated in FIG. 7*a* can be achieved.

In contrast to the prior art, the solutions according to the invention for different numbers of stripline arcs are now shown with reference to the examples considered below.

Figure 7B:
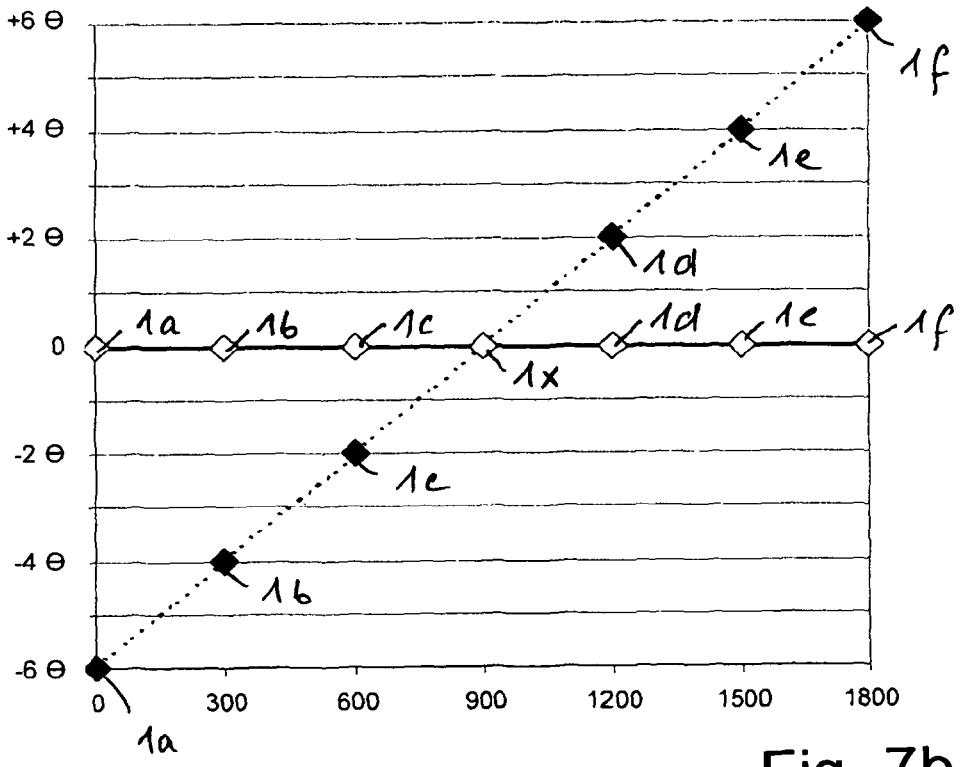
FIG. 7*b*: is a diagram corresponding to FIG. 2*b* of an example known from the prior art, as shown in FIG. 7*a;*

With reference to FIG. 7*a*, an embodiment is shown which is reproduced similarly to FIG. 2. In this embodiment a similar phase shifter assembly is used which has three circular-segment-shaped strip conductors 11, that is to say stripline portions 11*a*, arranged concentrically with one another and with a centre point 9. A pointer-shaped tapping element 15 is pivotable about the pivot axis and feed point 17 incident therewith. The discussed delays or reductions in propagation time are thus achieved, in accordance with which the individual radiators are controlled separately for each polarisation. The central radiators 1*x* shown in FIG. 7*a* or a central radiator group, which is possibly provided and is not shown here in greater detail, is fed directly without phase shift via the feed line 13 and the subsequent branch line 13*a*. The radii $R_N$:$R_2$:$R_1$ from the outside in behave like 6:4:2 (or 3:2:2:1) if the corresponding ratios are considered in relation to the embodiments according to FIGS. 2 to 6, where the radii are formed in a ratio of 5:3:1 from the outside in. In the example according to FIG. 7*a* phase shifts of 3ϕ, 2ϕ, 1ϕ can be achieved, for example, from the outermost to the innermost stripline portion 11*a*, that is to say changes to phase position in terms of the radiators of 6Θ, 4Θ, 2Θ, wherein Θ is a phase angle given by the position of the tapping element. Similarly to FIG. 2*b*, FIG. 7*b* shows the phase positions in a phase-controlled group antenna operated according to the prior art.

Figure 7C:
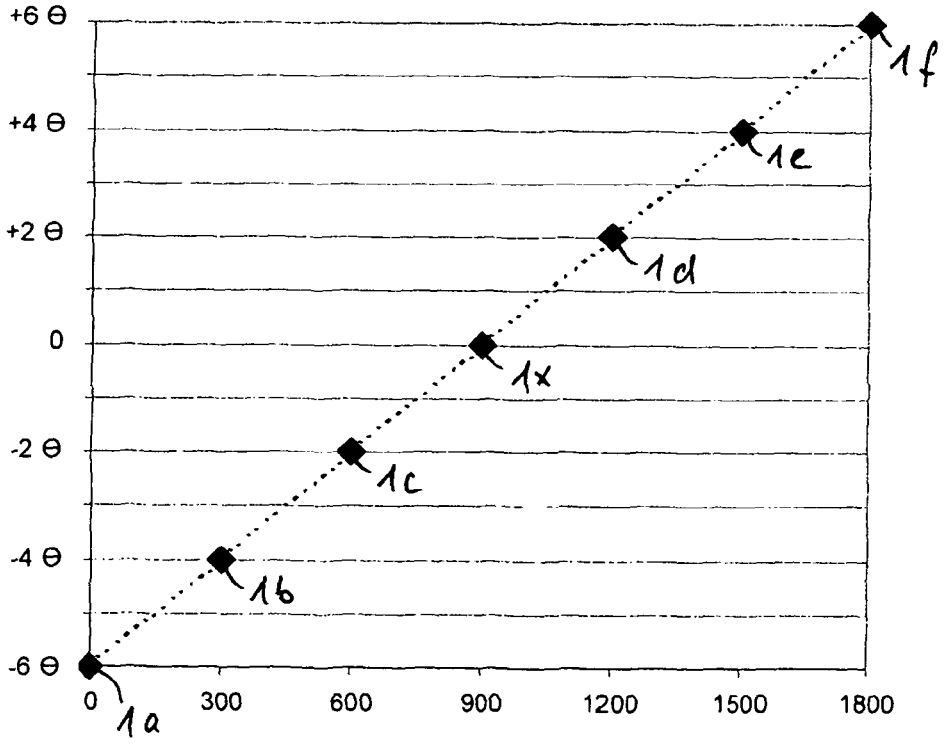
FIG. 7*c*: is a diagram corresponding to FIG. 2*c* of the example according to the prior art, as shown in FIG. 7*a;*

FIG. 7*c* shows a graph illustrating the maximum achievable phase shifts at the individual ports 19 of the circular-segment-shaped stripline portions 11, 11*a* and at the ports of the radiators or radiator groups.

Figure 8A:
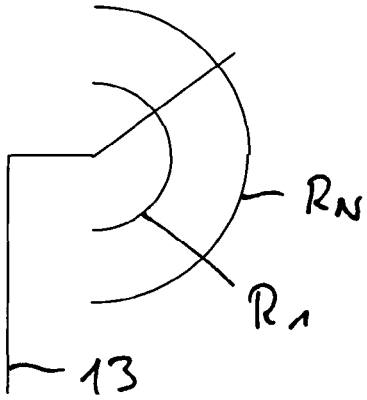

Phase Shifter with Two Circular-Segment-Shaped Striplines:

FIGS. 8*a* to 8*d* show embodiments with a phase shifter assembly which comprise two concentric circular-segment-shaped stripline portions, wherein, similarly to FIG. 7, a central radiator or a central radiator sub-group is controlled without phase shift independently of the adjustment of the phase shifter assembly. FIG. 8*a* again shows the arrangement of the prior art, in which the radius $R_N$ of the outer arc to the radius $R_1$ of the inner arc is 4:2 or 2:1.

Figure 8B:
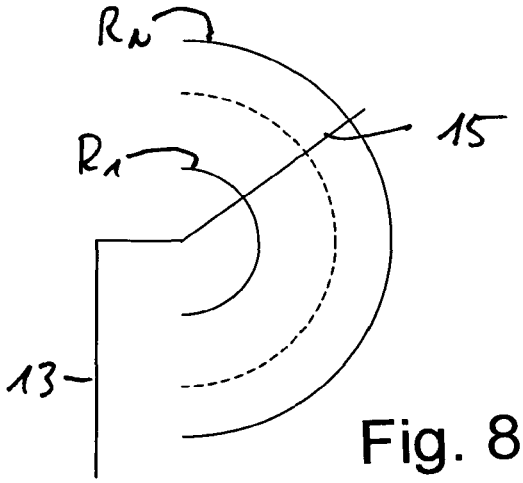
Figure 8C:
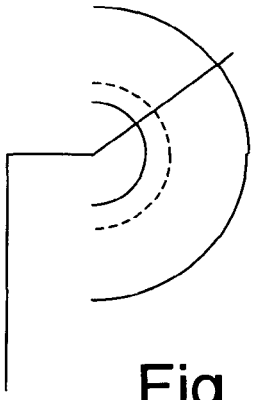
Figure 8D:
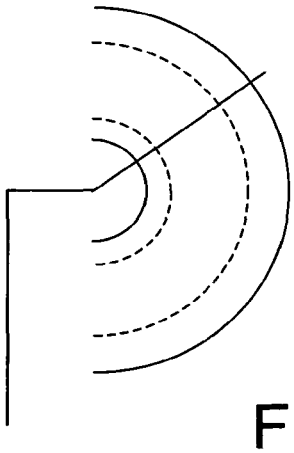
Figure 9A:
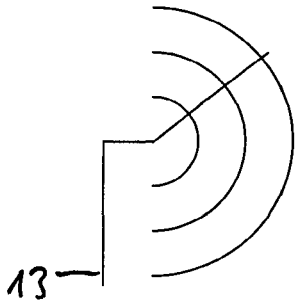

As in the other embodiments, the outer radius $R_N$ has also been increased in the second figure FIG. 8*b*, the inner radius $R_1$ has been reduced in FIG. 8*c* and both the outer radius $R_N$ has been increased and the inner radius $R_1$ has been reduced in FIG. 8*d* compared to the embodiments according to FIG. 9*a*. The corresponding values for the ratios of the radii are reproduced from the table.

The improvements according to the invention can be achieved if the ratio between the outermost and the innermost radius is greater than 2.2:1, preferably greater than 2.3:1 and in particular is 2.4:1. The maximum value of this ratio should lie beneath 4, preferably beneath 3.5 or 3.

Embodiment with Three Concentric Circular-Segment-Shaped Stripline Portions:

The corresponding ratios are reproduced in FIGS. 9*a* to 9*d* (where $R_N$:$R_2$:$R_1$=3:2: 1 in FIG. 9*d* according to the prior art) if seven radiators or radiator sub-groups are operated with a phase shifter assembly having three concentric circular-segment-shaped line portions, wherein the corresponding outer radii are again increased in the figures within the scope of the invention, the inner radii are reduced, or both the outer radius is increased and the inner radius is reduced. The corresponding ratios of the outermost and innermost radius are given in the accompanying tables. In accordance with the invention the ratio of $R_N$:$R_1$ should be ≥3.2, in particular 3.3 or 3.4. The maximum value of this ratio should be no greater than 6, preferably no greater than 5.5 and in particular no greater than 5.

Phase Shifter Assembly Having Four Circular-Segment-Shaped Stripline Portions:

Lastly, a corresponding embodiment of a phase shifter assembly having four concentric circular-segment-shaped stripline portions is shown with reference to FIGS. 10*a* to 10*d*, whereby a group antenna having 11 radiators or radiator sub-groups can ultimately be fed.

In contrast to the prior art, with such an odd number of radiators or radiator sub-groups the ratio of the radii of the stripline portions should not be 4:3:2:1, but instead the radius $R_N$ of the outermost stripline portion should be increased, the radius $R_1$ of the innermost stripline portion should be reduced or both the outermost radius should be increased and the innermost radius should be reduced. Optimal values can be inferred from the accompanying table.

In accordance with the invention the ratio of $R_N$:$R_1$ should also be greater than 4.2 in this embodiment and in particular should be greater than 4.3 or 4.4. The maximum value of this ratio should be no greater than 6, in particular no greater than 5.5 and in particular no greater than 5.

For antenna arrays with odd numbers of radiators and/or radiator groups, that is to say with a central radiator arrangement or radiator group which is not subjected to a change in phase position when the tapping element in the phase shifter assembly is moved, the following ratios between the outermost radius $R_N$ and the innermost radius $R_1$ of the stripline portions in the phase shifter assembly generally apply:

$$R_N:R_1 \geq n+0.2$$

where n is a natural number 2, 3, 4, . . . N in accordance with the number of used circular-segment-shaped line portions, in particular stripline portions in a corresponding phase shifter assembly.

If the example known in accordance with FIG. 2*a* from the prior art and the associated embodiments according to the invention are considered, the solution according to the invention can be described by the following inequalities:

$$Ph_N:Ph_1 \geq S_N:S_1+0.4$$

wherein $Ph_N$ is the phase shift which is caused by two different phase shifter adjustments (for example also in the form of a maximum possible phase shift) on the at least one radiator arrangement 1 furthest from the centre Z of the group antenna, and $Ph_1$ is the phase shift which is also caused by two corresponding, that is to say equally different phase shift adjustments (for example also in the form of a maximum possible phase shift) on the phase-controlled radiator arrangement 1 closest to the centre Z of the group antenna, and $S_N$ corresponds to the distance between the at least one furthest radiator arrangement 1 and the centre Z of the group antenna, and $S_1$ corresponds to the distance between the at least one radiator arrangement 1 closest to the centre Z of the group antenna and the centre Z of the group antenna, and wherein the centre Z of the group antenna corresponds to the phase-neutral centre position, which also remains unchanged with differently set phase positions.

These ratios can be reproduced as follows with regard to the embodiments:

FIGS. 4*a* to 4*d*: $S_N$:$S_1$=3:1 and $Ph_N$:$Ph_1$>3.4
FIGS. 5*a* to 5*d*: $S_N$:$S_1$=5:1 and $Ph_N$:$Ph_1$>5.4
FIGS. 6*a* to 6*d*: $S_N$:$S_1$=7:1 and $Ph_N$:$Ph_1$>7.4

In these embodiments the following inequality in terms of the phase shifts should be implemented in order to achieve the advantages according to the invention:

$$Ph_N:Ph_1 \geq S_N:S_1+k$$

wherein k corresponds to a value of 0.4, in particular 0.5, 0.6 or preferably 0.8.

The following inequality shall also be adequate for the ratio of phase shifts or distances of radiators based on the centre Z:

$$n+m \geq Ph_N:Ph_1 \geq S_N:S_1$$

wherein n corresponds to the number of circular-segment-shaped stripline portions in a phase shifter assembly or the number of radiator arrangements 1 on one side of the centre Z of the group antenna, and m corresponds to the value 2.0 or preferably 1.5 or 1.0.

In the embodiments according to FIG. 7*a* et seq. with an odd number of radiators or radiator groups with a phase-neutral central feed, the following distance ratios between the outermost radiators 1*a* to if and the radiator lx fed phase-neutrally in the centre are given:

FIGS. 8*a* to 8*d*: $S_N:S_1=2:1$ and $Ph_N:Ph_1>2.2$

FIGS. 9*a* to 9*d*: $S_N:S_1=3:1$ and $Ph_N:Ph_1>3.2$

FIGS. 10*a* to 10*d*: $S_N:S_1=4:1$ and $Ph_N:Ph_1>4.2$

In these embodiments the following inequality in terms of the phase shifts should be implemented in order to achieve the advantages according to the invention:

$$Ph_N:Ph_1 \geq S_N:S_1+k$$

wherein k corresponds to a value of 0.2, in particular 0.25, 0.30 or preferably 0.40.

The following inequality shall also be adequate as the upper limit for the ratio of phase shifts or distances of radiators based on the centre Z:

$$n+m\ Ph_N:Ph_1 \geq S_N:S_1$$

wherein n corresponds to the number of circular-segment-shaped stripline portions in a phase shifter assembly or the number of radiator arrangements 1 on one side of the centre Z of the group antenna, and m corresponds to a value of 4.0 or may preferably be 3.5 or 3.0.

In each case the maximum values for the ratios of the phase shifts may be inferred from the accompanying enclosed tables in terms of the examples according to FIGS. 4*a* to 6*d* and 8*a* to 10*d*.

The advantages according to the invention will be proven with reference to individual specific examples.

Figure 9B:
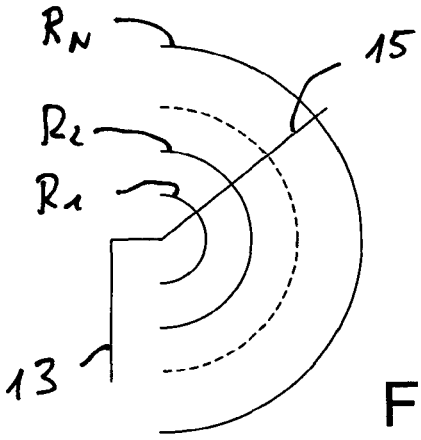
Figure 9C:
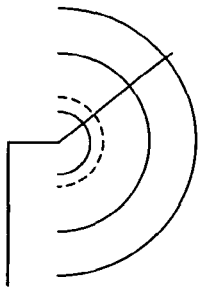
Figure 9D:
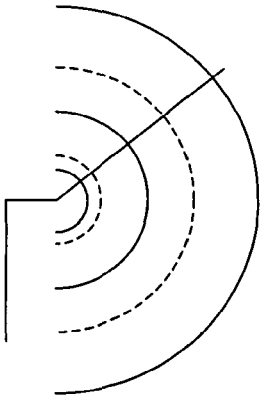
Figure 11A:
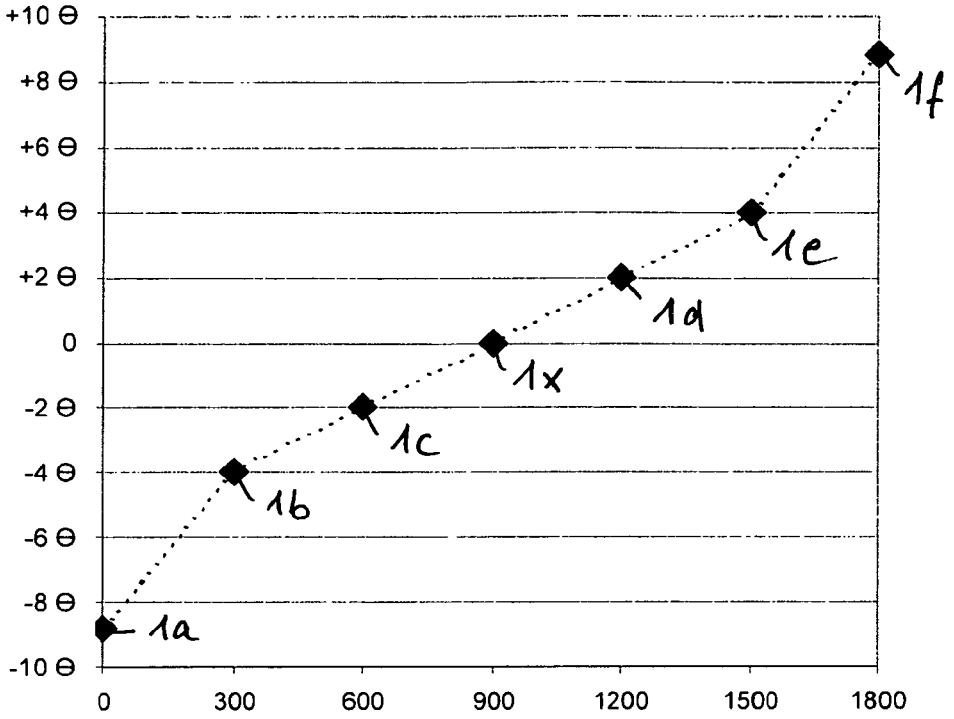
FIG. 11*a*: is a diagram corresponding to FIG. 3*c* of a phase shifter assembly according to the invention, as shown in FIG. 11*a;*
Figure 11B:
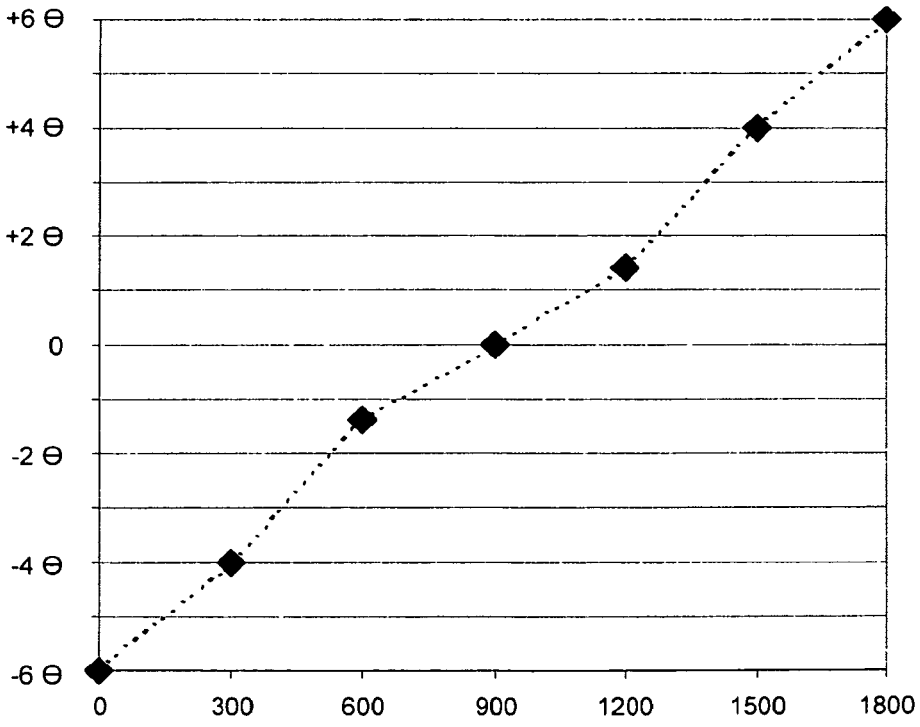
FIG. 11*b:* is a diagram corresponding to FIG. 3*c* of a phase shifter assembly according to the invention, as illustrated on the basis of FIG. 11*b;*

Similarly to the graph shown in FIG. 3*c*, a graph is reproduced in FIG. 11*a* for the embodiment according to FIG. 9*b*, from which it can be seen that the ports 19 of the largest stripline arc of the phase shifter experience a disproportionately large phase shift for the furthest radiators or radiator groups. In the example according to FIG. 9*c* a phase shift in relation to the radiators or radiator groups closest to the centre of the antenna is achieved by the smallest stripline arc, which radiators or radiator groups experience a disproportionately small phase shift (reproduced in FIG. 11*b*).

With reference to FIGS. 12*a* to 12*d*, radiation field patterns for an array comprising six elements (as described generally with reference to FIGS. 5*a* to 5*d*), that is to say a group antenna, are shown which have an even number of radiators or radiator sub-groups and are not fed with a phase position, which is independent of the setting of the phase shifter, for a central radiator or radiator group.

The respective beam tilt, the angle of the first upper side lobe and the level of the first upper side lobe for FIGS. 12*a* to 12*d* can be inferred from the table below.

Figure 12A:
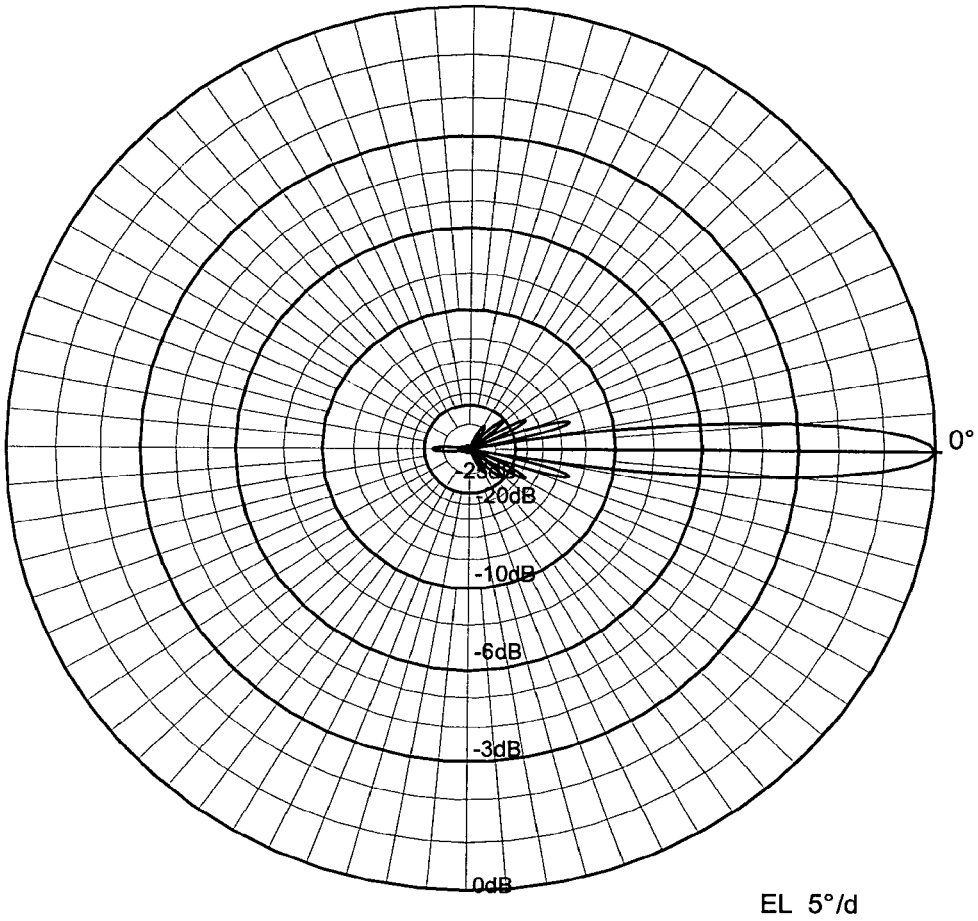
FIGS. 12*a* to 12*d*: show four radiation field patterns illustrating the level of the first secondary lobe above the primary lobe without tilting, with a corresponding tilting and with a ratio, amended in accordance with the invention, of the radii of the stripline portions of the phase shifter assembly for a first embodiment.
Figure 12B:
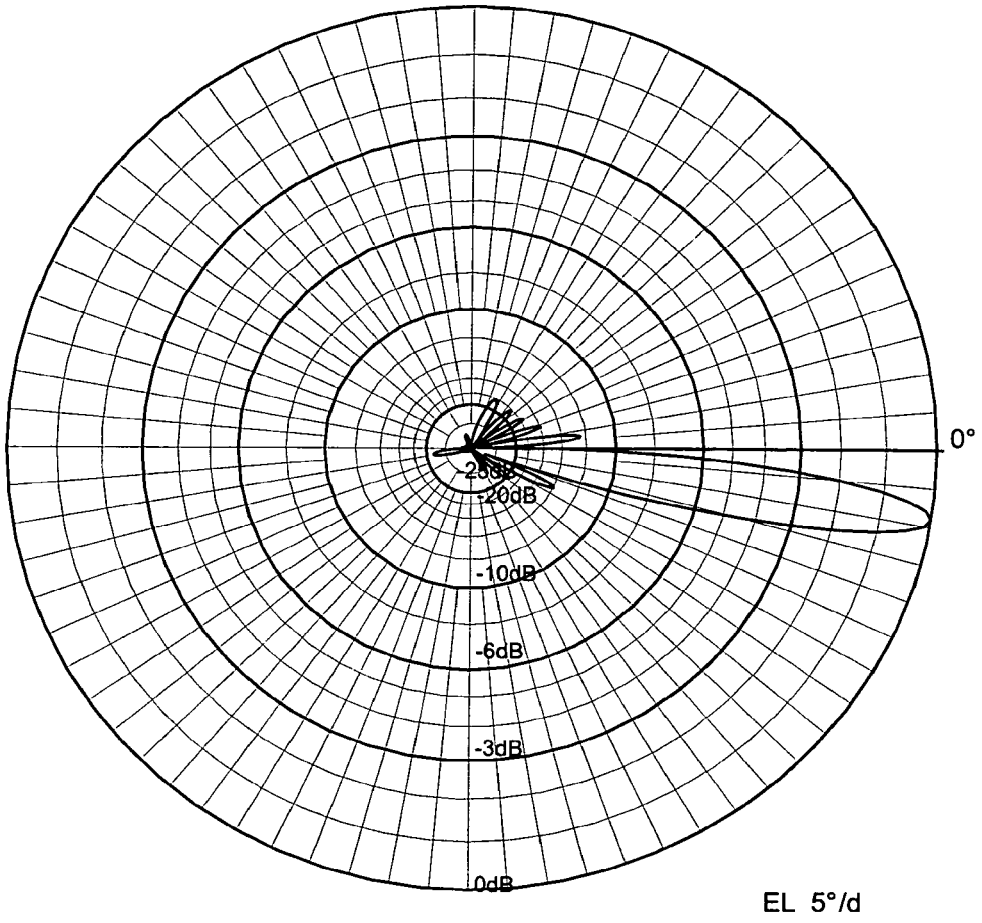
Figure 12C:
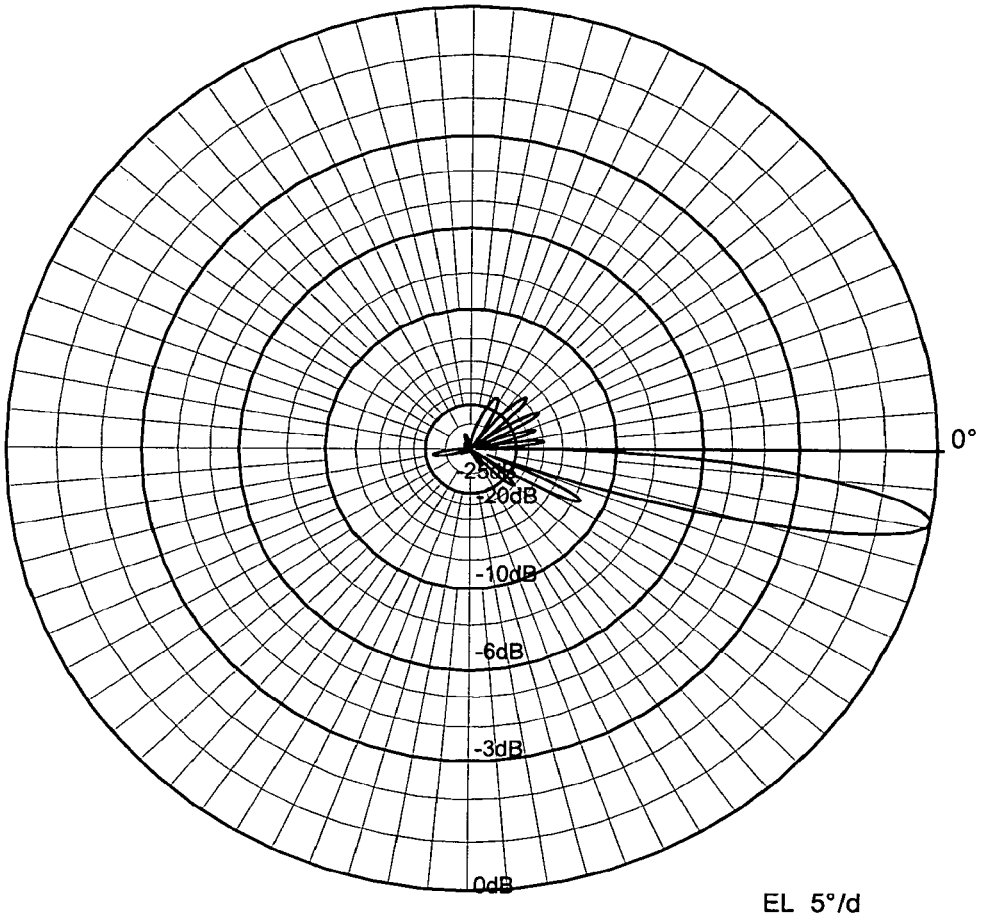
Figure 12D:
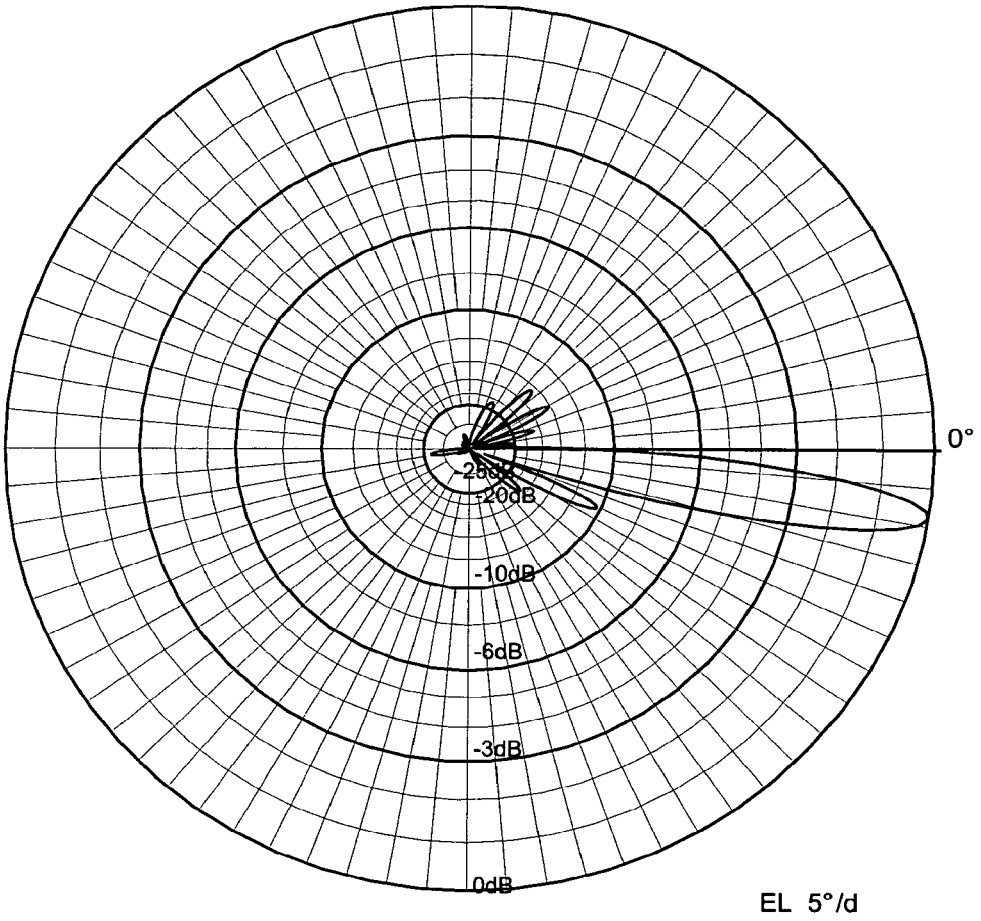

| | Beam tilt | Angle of 1st upper side lobe | Level of 1st upper side lobe |
|---|---|---|---|
| FIG. 12a | 0° | 16° | −13.0 dB |
| FIG. 12b | 9° | 7° | −12.4 dB |
| FIG. 12c | 9° | 6° | −15.9 dB |
| FIG. 12d | 9° | 7° | −20.1 dB |

The aforementioned six radiators 1 are each positioned at a distance of 285 mm in the vertical direction in the embodiment shown. FIG. 12*a* shows the radiation field pattern without tilting of the main lobe. The first upper side lobe points in the direction elevation 16' and has a level of −13 dB.

FIG. 12*b* shows a variation in which the phase shifter according to the prior art has a radius ratio of 1:3:5, that is to say it generates a phase shift in relation to the individual radiators at this ratio. These phase shifts occur both at the phase shifter outputs and at the radiator ports. Since the phases of each radiator are different at two different settings, the values are independent of the respective feed line lengths of the individual radiators.

FIG. 12*b* shows a beam tilt according to the prior art. Adjacent radiators each have the same phase difference. If the centre of the antenna is selected as a reference, the phases of the radiators lie at −125°, −75°, −25°, 25°, 75°, 125° (from bottom to top). A main lobe tilted by 9° can be seen, wherein the first upper side lobe is also tilted and now points in elevation 7°. The level of the side lobe has increased by 0.6 dB to −12.4 dB.

In accordance with the method according to the invention (as shown in FIG. 12*c*), a modified phase shifter is now formed witha radius ratio of 1:3:6. The radiation field pattern of FIG. 12*a* remains unchanged with a beam tilt of 0°. If the main beam direction is tilted to 9°, the phases of the outer radiators now increase and, in turn, based on the centre of the antenna, these are now −135°, −67.5°, −22.5°, 22.5°, 67.5°, and 135°. The first upper side lobe in FIG. 12*c* points in elevation 6°, wherein the level now lies at −15.9 dB, that is to say 2.9 dB lower than in the prior art.

The effect in a phase shifter having a radius ratio of 1:3:7 or such a phase shift ratio is even more pronounced, the result being reproduced with reference to FIG. 12*d*. Whilst in this case, too, the radiation field pattern according to FIG. 12*a* also further applies to a beam tilt of 0°, the outer radiators experience a phase shift which is increased once more. A tilt of 9° is achieved if the phases of the radiators based on the centre are −133°, −57°, −19°, 19°, 57° and 133°. The first upper side lobe at 7° is now even tilted to a level of −20.1 dB, which is an improvement over the prior art of 7.7 dB.

Owing to the amended field pattern shape, the gain of the antenna is reduced slightly by 0.2 dB or 0.3 dB compared to the prior art if the main beam direction is tilted to 9°. This is tolerable, since the supply field is also correspondingly small. If there is no, or minimal beam tilt, the pattern has the same shape as the prior art and there are no gain losses.

Further illustrations are shown in the accompanying FIGS. 13*a* to 13*d* (which generally correspond to the variations according to FIGS. 9*a* to 9*d*), more specifically for a 7-element array, that is to say a group antenna having seven radiators or radiator sub-groups arranged at the same distance from one another, wherein a central radiator or a central radiator sub-group is fed phase-neutrally, that is to say does not experience any change to phase position with a different setting of the tapping element of the phase shifter assembly.

Figure 13A:
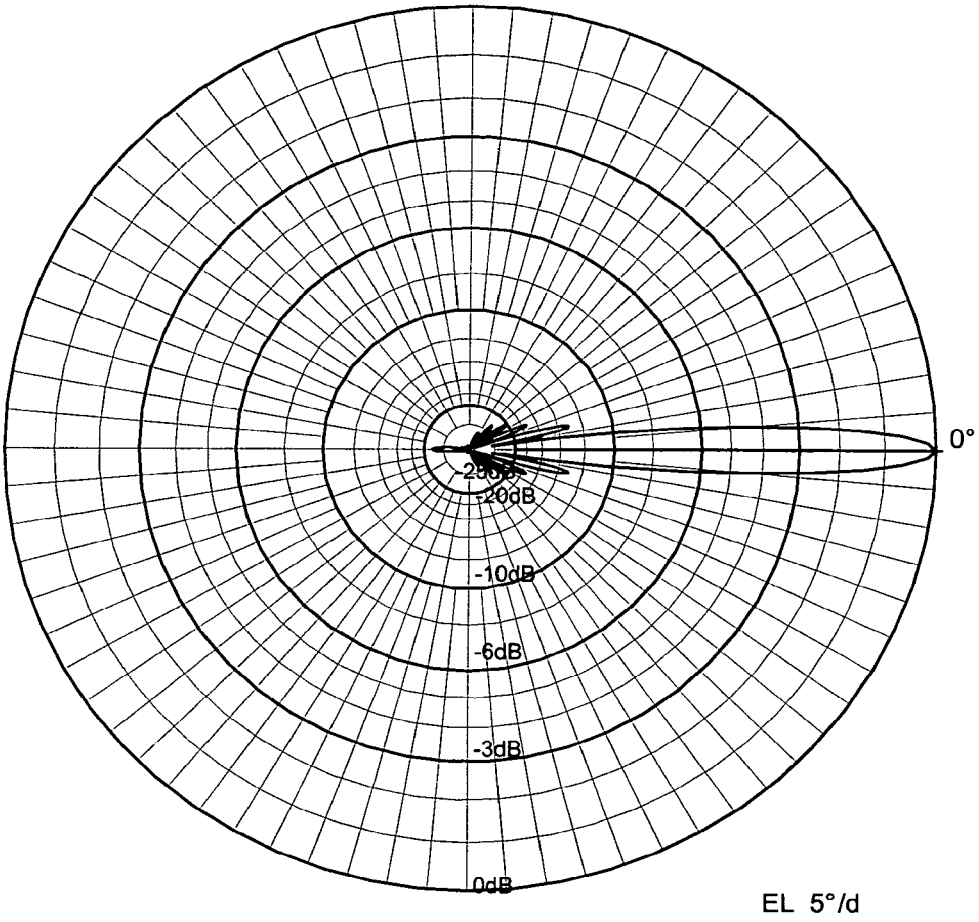
FIGS. 13*a* to 13*d*: show four radiation field patterns illustrating the level of the first secondary lobe above the primary lobe without tilting, with a corresponding tilting and with a ratio, amended in accordance with the invention, of the radii of the stripline portions of the phase shifter assembly for a second embodiment.
Figure 13B:
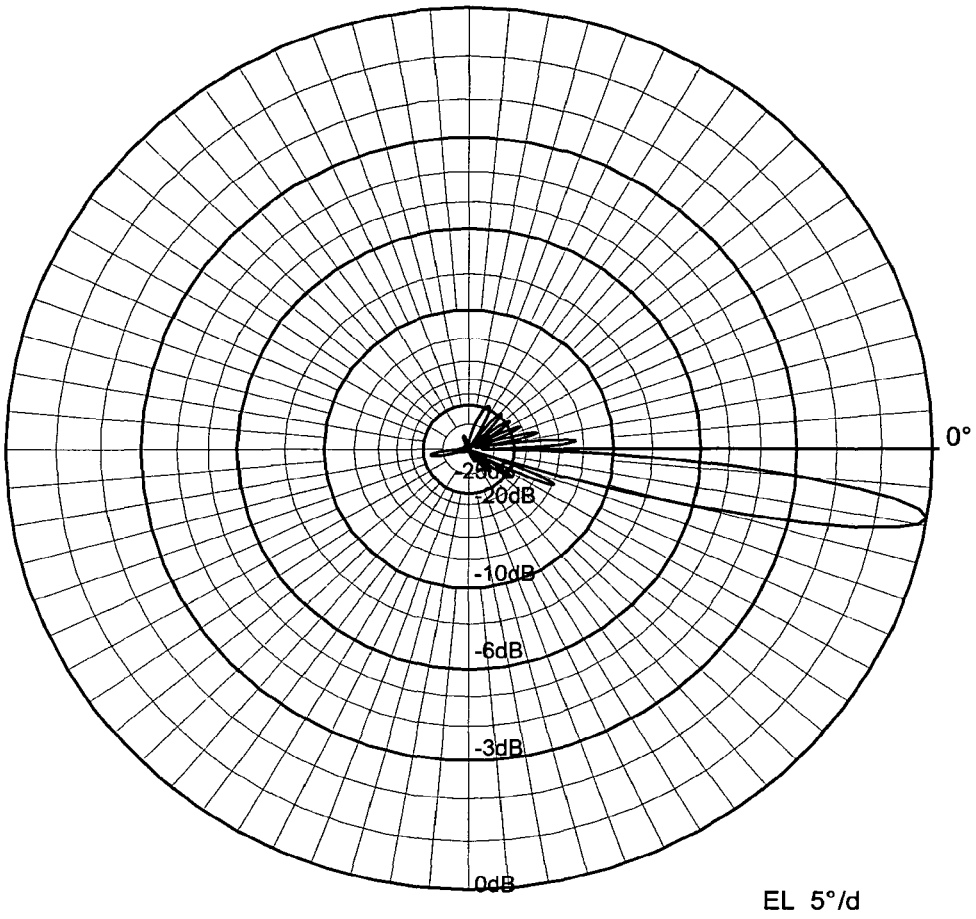
Figure 13C:
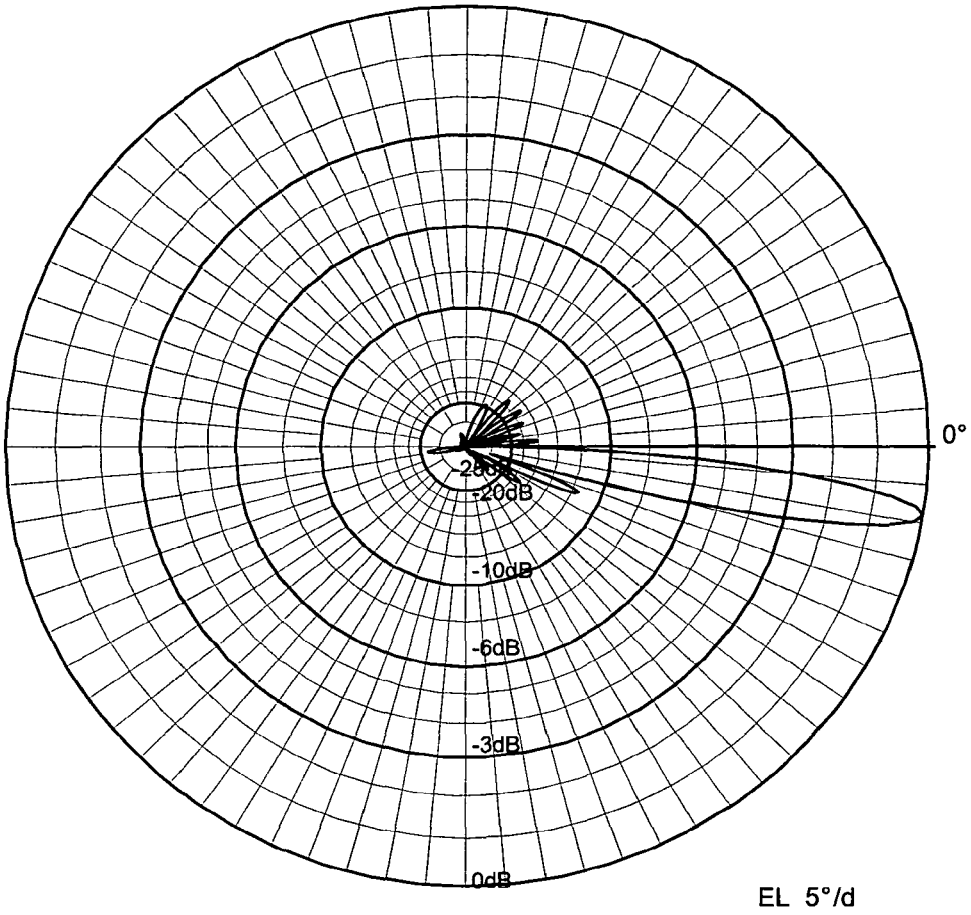
Figure 13D:
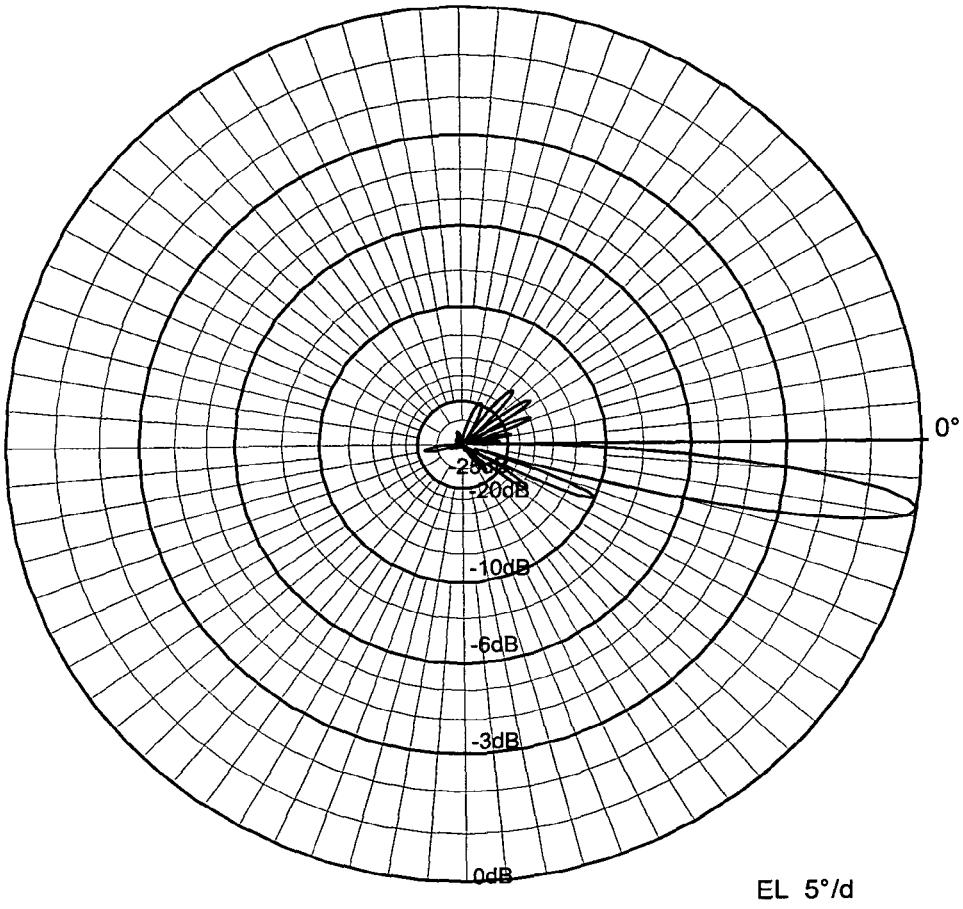

The different beam tilts shown in FIGS. 13*a* to 13*d* are reproduced in the following table:

| | Beam tilt | Angle of 1st upper side lobe | Level of 1st upper side lobe |
|---|---|---|---|
| FIG. 13a | 0° | 14° | −13.1 dB |
| FIG. 13b | 9° | 4° | −12.6 dB |
| FIG. 13c | 9° | 4° | −16.2 dB |
| FIG. 13d | 9° | 4° | −21.7 dB |

The aforementioned seven radiators are each positioned at a distance of 285 mm in the vertical direction. FIG. 13*a* shows the radiation field pattern without tilting of the main lobe. The first upper side lobe points in the direction 14° and has a level of −13.1 dB.

In accordance with the method according to the invention, a modified phase shifter is now used with a radius ratio of 2:4:6 (1:2:3) or generates phase shifts for each radiator at this ratio. These phase shifts occur both at the phase shifter outputs and at the radiator ports. Since the phases of each radiator are different at two different settings, the values are independent of the respective feed line lengths of the individual radiators.

FIG. 13*b* shows a beam tilt according to the prior art. Adjacent radiators each have the same phase difference. If the centre of the antenna is selected as a reference, the phases of the radiators lie at −150°, −100°, −50°, 0°, 50°, 100° and 150° (from bottom to top), A main lobe tilted by 9° can be seen, wherein the first upper side lobe is also tilted and now points in elevation 4°. The level of the side lobe has increased by 0.5 dB to −12.6 dB.

In accordance with the method according to the invention, a modified phase shifter is now formed with a radius ratio of 2:4:7 (1:2:3.5). The radiation field pattern of FIG. 13*a* remains unchanged with a beam tilt of 0°. If the main beam direction is tilted to 9°, as shown in FIG. 13*c*, the phases of the outer radiators now increase and, in turn, based on the centre of the antenna, these are now −157°, 90°, 45°, 0, 45°, 90° and 157°. The first upper side lobe in FIG. 13*c* points in elevation 4°, wherein the level now lies at −16.2 dB, that is to say 3.6 dB lower than in the prior art.

The effect in a phase shifter having a ratio of 2:4:8 (1:2:4) or such a phase shift ratio is even more pronounced. The result is shown in FIG. 13*d*. Whilst in this case, too, the radiation field pattern according to FIG. 13*a* also further applies to a beam tilt of 0°, the outer radiators experience a phase shift which is increased once more. A tilt of 9° is achieved if the phases of the radiators based on the centre are −164°, 82°, 41°, 0°, 41°, 82° and 164°. The first upper side lobe at 4° is now even tilted to a level of -21.7 dB, which is an improvement over the prior art of 9.1 dB.

Owing to the amended field pattern shape, the gain of the antenna is reduced slightly by 0.2 dB or 0.3 dB compared to the prior art if the main beam direction is tilted to 9°. This is tolerable, since the supply field is also correspondingly small. If there is no, or minimal beam tilt, the pattern has the same shape as the prior art and there are no gain losses.

Figure 10A:
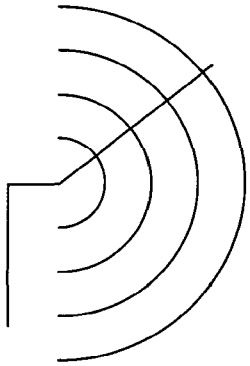
Figure 10B:
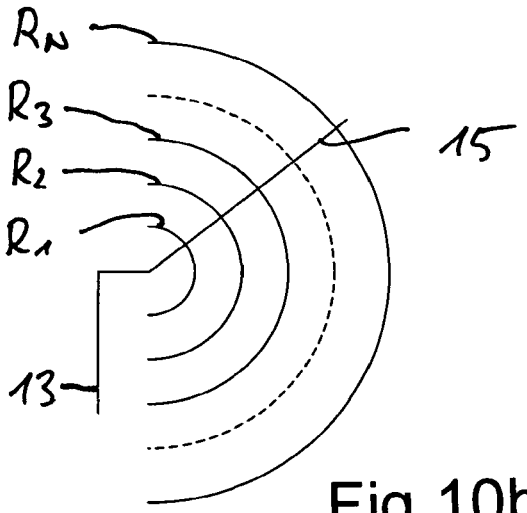
Figure 10C:
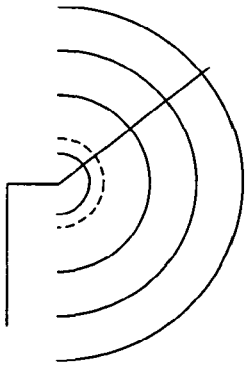
Figure 10D:
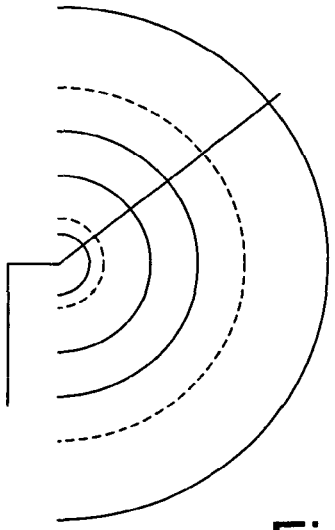
Figure 14A:
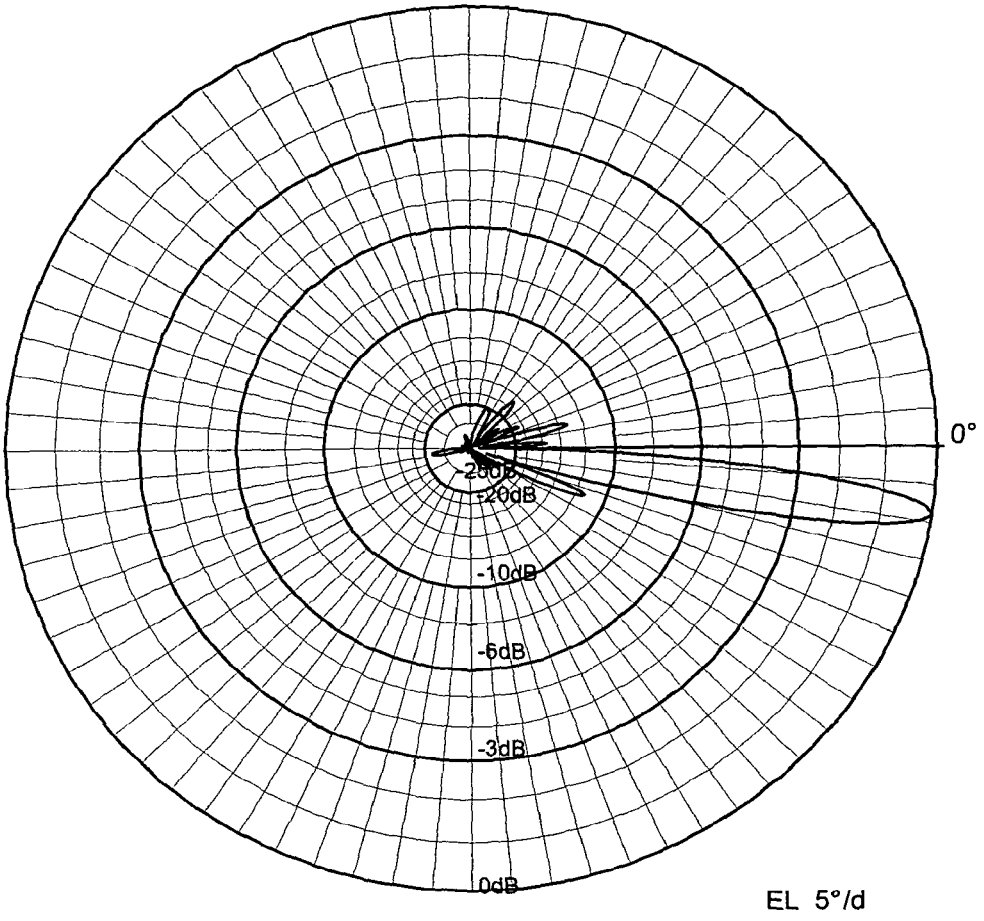
FIGS. 14*a* to 14*b*: are two radiation field patterns illustrating the level of the first secondary lobe above the primary lobe with a ratio, amended in accordance with the invention, of the radii of the stripline portions of the phase shifter assembly for a third embodiment.
Figure 14B:
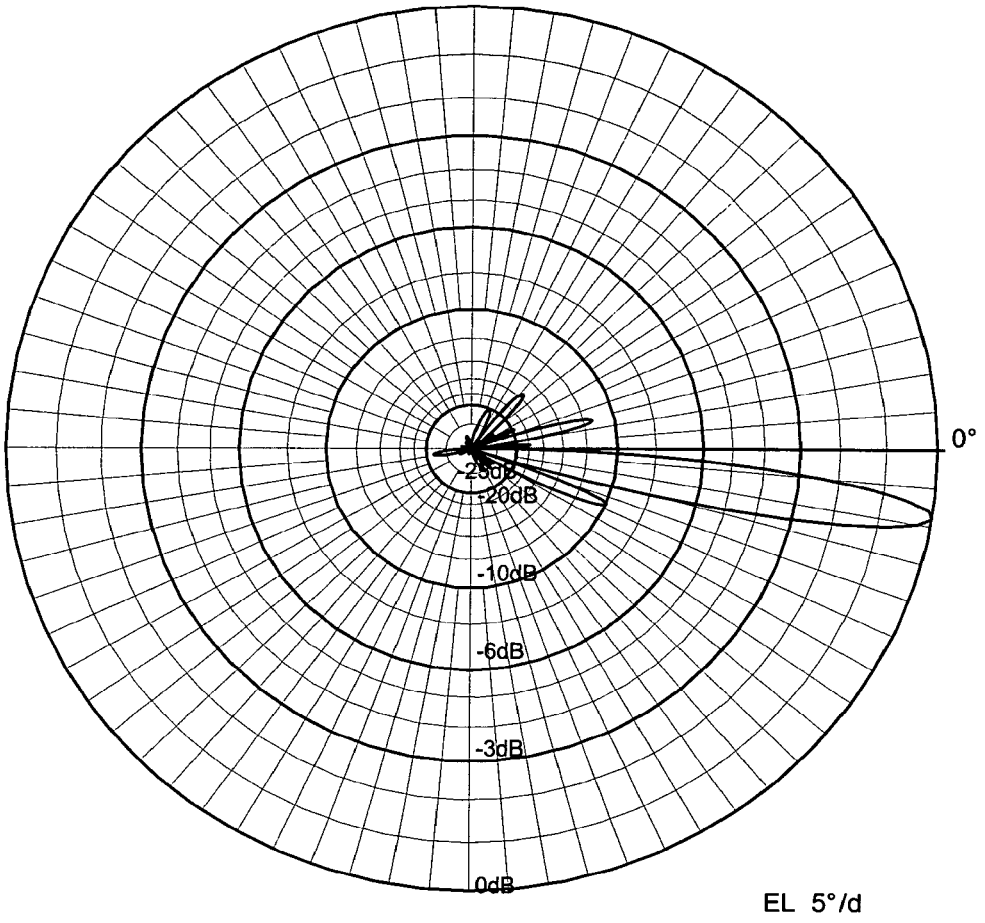

Following on from the two previous embodiments, FIGS. 14*a* and 14*b* show the corresponding ratios when an antenna having a 7-element array is used, in which the radius of the outermost stripline portion is increased compared to conventional solutions and, at the same time, the radius of the innermost stripline portion is reduced, as was illustrated schematically in essence in FIG. 10*d*. Since the radiator arrangement also consists of seven radiators, as in the previous example according to FIGS. 13*a* to 13*d*, the radiation field pattern produced with this embodiment without tilting corresponds to that of FIG. 13*a*, wherein in this present embodiment a radiation field pattern with a beam tilt according to the prior art further corresponds to that of the embodiment according to FIG. 13*b*.

In relation to this further embodiment only FIGS. 14*a* and 14*b* are therefore appended, which show field patterns having the following conditions:

| | Beam tilt | Angle of 1st upper side lobe | Level of 1st upper side lobe |
|---|---|---|---|
| FIG. 14a | 9° | 4° | −15.6 dB |
| FIG. 14b | 9° | 4° | −17.8 dB |

By contrast to the prior art the inner arc radius is now reduced and the ratio of the radii is 1.4:4:6 (0.7:2:3). The central radiator has no variable phase shift. The second inward radiators are fed from the innermost arc of the phase shifter and thus achieve reduced phase shift compared to the prior art.

If the main beam direction is tilted to 9° the phases of the outer radiators now increase and, in turn, based on the centre of the antenna, these are now −150°, 100°, 35°, 0, 35°, 100° and 150°. The first upper side lobe in FIG. 14*a* points in elevation 4°, wherein the level now lies at −15.6 dB, that is to say 3 dB lower than in the prior art.

The effect in a phase shifter having a radius ratio of 1:4:8 (0.5:2:4) or such a phase shift ratio is even more pronounced. The corresponding results are shown in FIG. 14*b*. Whilst in this case, too, the radiation field pattern according to FIG. 13*a* also further applies to a beam tilt of 0°, the two inner radiators experience a phase shift which is reduced once more. A tilt of 9° is achieved if the phases of the radiators based on the centre are −150°, −100°, 25°, 0°, 25°, 100° and 150°. The first upper side lobe at 4° is now tilted to a level of −17.8 dB, which is an improvement over the prior art of 5.2 dB.

Owing to the amended field pattern shape, the gain of the antenna is reduced slightly by 0.2 dB or 0.3 dB compared to the prior art if the main beam direction is tilted to 9°. This is tolerable, since the supply field is also correspondingly small. If there is no, or minimal beam tilt, the field pattern has the same shape as in the prior art and there are no gain losses.

The invention has been explained for the case in which a phase shifter assembly is used which has two or more stripline portions arranged relative to one another in a circular-segment-shaped manner, over which a tapping element can be moved. As explained, such an assembly can be used for an antenna group comprising an even or odd number of elements, depending on whether a central radiator or a radiator group is controlled with or without phase shift.

For example, by contrast to the embodiments shown, striplines which have different centre points may also be used. It is thus conceivable, for example, for the outermost radius $R_N$ to be increased compared to the other radii (that is to say it no longer coincides with the centre point of the other radii) so that, for example, the outer radius is infinite in the extreme case and the stripline portion becomes increasingly straighter starting from an arc of a circle, that is to say it is perfectly straight in the extreme case. This ultimately results in a shift of the point of coupling 23 on the tapping element.

Lastly, comparable results can also be achieved if, for example, the ratio of the radii starting from a standard radius ratio of 1:2:3 for example (with an odd number of radiators or radiator groups for example) or with a standard radius ratio of 1:3:5 (for example in an antenna with an even number of radiators or radiator groups) is retained, for example if the outermost stripline with the greatest radius has one or preferably two (on opposite sides, that is to say top and bottom based on the stripline) intermediate dielectric layers. It is merely essential that the selected dielectric (that is to say not air) lowers the phase velocity of the signal over the arc-shaped stripline. The phase shifter according to the invention can be formed with or without an upper screening. In this case the dielectric is most effective when it is located between the arc-shaped stripline 11, 11*a* and the earthing. A possible dielectric material above the line and overlapping the line has a lesser effect since it is only located in the stray field of the microstripline.

For example, the aforementioned one or more intermediate dielectric layers may also only be formed over a partial length of the arc-shaped striplines, may be provided over the length of the arc or a partial length at a different density, may decrease or increase over the length or a partial length, or may also have a different permittivity. In this case, within the meaning of the invention it is possible in further areas to change the phase positions with an adjustment of the phase shifter towards the innermost stripline arc in relation to the outermost stripline arc, not linearly but disproportionately.

A factor K can be defined for the ratio of phase velocity with or without insertion of an additional dielectric. Provided that the entire arc length is formed in this manner, the ratio of the maximum phase velocities at the phase shifter ports or at the radiator ports is, for example:

$$1:2:(3/K)$$

in the case of a phase shifter assembly having three striplines, via which an antenna with an odd number of radiators or radiator groups (that is to say seven radiators or radiator groups) is fed.

In terms of the ratio of the innermost radius to the outermost radius, the formula could be:

$$1:(N/K)$$

wherein N is the number of stripline portions or arcs, as formed with an odd number of radiators or radiator groups.

In the case of an antenna having an even number of radiators or radiator groups, the formula in relation to the ratio of the innermost stripline portion to the outermost stripline portion would be as follows:

$$1:(2N/K)$$

For example, the dielectric material may be selected in such a way that it has a relative permittivity $\epsilon$ of 30. The phase velocity can thus be lowered maximally by a factor K of 0.18 compared to the use of air as a dielectric. Cases in which the radius of the outer stripline arc 11, 11*a* is not increased compared to the standard case are of particular interest. The entire space requirement of the phase shifter in not increased in this case. At a radius ratio of 1:3:5, a phase shift ratio of 1:3:6 can thus be achieved with a value for K of approximately 0.83. If the value of K were lowered at the same radius ratio to approximately 0.71, a phase shift ratio of 1:3:7 for example would be produced. Similarly to achieving a comparable effect by using a corresponding dielectric, this therefore clarifies whether the radii of the individual stripline arcs are changed accordingly.

Figure 15:
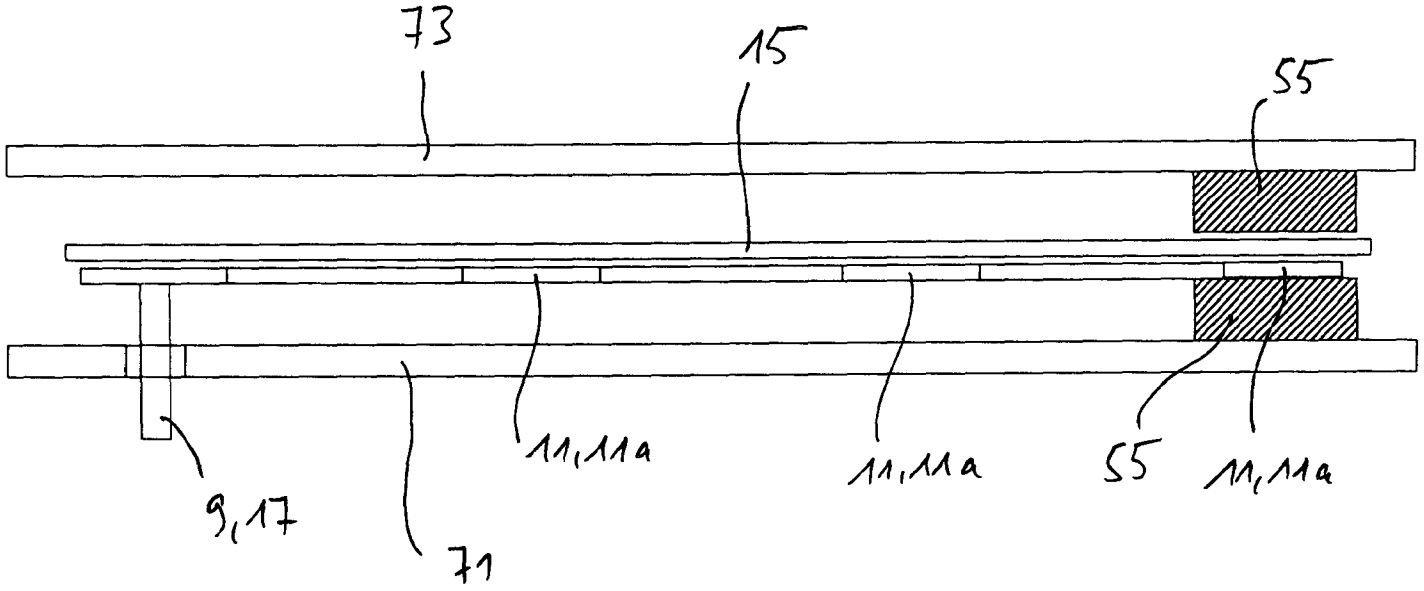
FIG. 15: is a cross-sectional view through the phase shifter assembly with additional use of layers made of dielectric.

Referring to FIG. 15, a schematic cross-section through such a phase shifter is illustrated, which comprises three stripline arcs 11 for example which are arranged at a standard radius ratio of 1:2:3 if an additional radiator or an additional radiator group of the phase-neutral centre position of the antenna is fed in the centre Z. The outermost stripline comprises the aforementioned two dielectric intermediate layers 55, which are arranged above and below the outermost stripline arc 11.

Furthermore, FIG. 15 also shows not only the base or base plate 71, but also an associated, likewise electrically conductive cover or housing cover 73, from which it is also clear that the dielectric intermediate layers 55 are fixed to the base 71 or to the inner face of the cover 73, and that the outermost stripline arc 11, 11*a* is arranged for example on the dielectric 55 positioned and held on the base and is provided at a distance above the dielectric 55 fixed on the inner face of the cover 73, more specifically at such a distance from the outermost stripline arc 11 that the tapping element can still also be moved over the stripline arc 11, 11*a* between the two dielectrics 55.

The resultant phase shift is ultimately increased by the aforementioned use of dielectric material with a constant arc radius. If the aforementioned dielectric were not placed uniformly along the preferably outer stripline arc, the phase shift achievable would ultimately depend on the selection of the phase shifter position.

Lastly, with use of dielectric material with stripline portions 11 arranged at conventional standard ratios, a situation may arise in which, for example, the outermost arc-shaped stripline portion lies disproportionately further from the centre point and/or an innermost stripline portion closest to the centre point lies closer to this centre point. The latter concept can be implemented if, for example, only the innermost or smallest stripline arc has no dielectric layers, whereas the stripline portions provided between the innermost and outermost stripline arcs are provided with a dielectric and/or, for example, the outermost stripline arc is equipped with a dielectric having yet greater permittivity. Ratios can thus be achieved as were detailed, for example, in FIG. 4*d*, 5*d*, 6*d*, 8*d*, 9*d* or 10*d*.

However, the advantages according to the invention can be achieved with any construction which ultimately contributes to an identical or similar change in phase position.

The invention can thus still be implemented similarly even if a multi-phase shifter assembly, as detailed and described above, is not used, but for example single phase shifters instead, such as a single differential phase shifter having only one circular-segment-shaped line portion and an associated tapping element, via which a radiator or a radiator group can be fed only at the two port ends of said line portion. If the individual phase shifters do not have differently dimensioned line portions (stripline portions) with different radii, but are identically designed, corresponding gear transmissions must be used, as is known per se, in order to adjust the different phase shifters to different extents. In other words, a transmission gear could thus be used which contributes to a more pronounced or disproportionate change in phase position for the feed of the outermost radiator, that is to say the furthest radiator. The same applies to the innermost radiators or radiator groups.

Generally, the principle according to the invention is based on the fact that, when controlling an increasingly greater downtilt angle, a disproportionate increase in phase difference is to be achieved simultaneously, with which the furthest radiators are fed in proportion to the innermost radiators.

The invention has been described on the basis of a group antenna in particular for a mobile communications system with regard to the tilting of the downtilt angle. The invention can similarly also be used for a horizontally orientated antenna array, in which the pivot angle is to be pivoted in a horizontal plane or with a component in the horizontal direction instead of in the vertical direction or with a component in the vertical direction.

Referring to the accompanying tables, preferred ratios according to the invention of the radii of the outermost and innermost radii respectively are given for different phase shifter assemblies having a different number of stripline portions, wherein these ratios ultimately also provide the phase shifts achievable in terms of the outermost stripline portion to the innermost stripline portion.

Even Number of Radiators/Radiator Groups (No Centre Feed Without Phase Shift)

| | Number of stripline portions | | |
|---|---|---|---|
| | 2 (FIGS. 4a to 4d) $R_N$:$R_1$ | 3 (FIGS. 5a to 5d) $R_N$:$R_1$ | 4 (FIGS. 6a to 6d) $R_N$:$R_1$ $Ph_N$:$Ph_1$ |
| Example a | =3:1 | =5:1 | =7:1 |
| Example b | =3.8:1 | =5.9:1 | =7.5:1 |
| Example c | =3:0.7 (=4.29:1) | =5:0.8 (=6.33:1) | =7:0.8 (=8.75:1) |
| Example d | =3.4:0.9 (=3.8:1) | =5.7:0.9 (=6.33:1) | =7.1:0.8 (=8.9:1) |
| Invention | >3.4:1 | >5.4:1 | >7.4:1 |
| preferably | >3.5:1 | >5.5:1 | >7.5:1 |
| or | >3.6:1 | >5.6:1 | >7.6:1 |
| or | >3.8:1 | >5.8:1 | >7.8:1 |
| preferably | <7:1 | <9:1 | <11:1 |
| or | <6.5:1 | <8.5:1 | <10.5:1 |
| or | <6:1 | <8:1 | <10:1 |

Odd Number of Radiators/Radiator Groups (with Centre Feed Without Phase Shift)

| | Number of stripline portions | | |
|---|---|---|---|
| | 2 (FIGS. 8a to 8d) $R_N$:$R_1$ | 3 (FIGS. 9a to 9d) $R_N$:$R_1$ | 4 (FIGS. 10a to 10d) $R_N$:$R_1$ $Ph_N$:$Ph_1$ |
| Example a | =2:1 | =3:1 | =4:1 |
| Example b | =2.7:1 | =4.4:1 | =5.2:1 |
| Example c | =2:0.7 (=2.9:1) | =3:0.7 (=4.3:1) | =4:0.7 (=5.7:1) |
| Example d | =2.5:0.8 (=3.1:1) | =3.6:0.8 (=4.5:1) | =4.6:0.8 (=5.8:1) |
| Invention | >2.2:1 | >3.2:1 | >4.2:1 |
| preferably | >2.25:1 | >3.25:1 | >4.25:1 |
| or | >2.30:1 | >3.30:1 | >4.30:1 |
| or | >2.40:1 | >3.40:1 | >4.40:1 |
| preferably | <4:1 | <5:1 | <6:1 |
| or | <3.5:1 | <4.5:1 | <5.5:1 |
| or | <3:1 | <4:1 | <5:1 |

The invention claimed is:

1. Method for operating a phase-controlled group antenna comprising a plurality of radiator arrangements arranged in a direction of assembly and each having at least one radiator or radiator group with a plurality of individual radiators, the distances (D) between two adjacent radiator arrangements being equal or deviating from one another by less than 15% and all or some of the radiator arrangements being controlled via one or more phase shifters for beam pivoting, the method comprising:

feeding at least one outermost radiator arrangement furthest from a center (Z) of the group antenna in the direction of assembly of the radiator arrangement as a function of the setting of the beam pivot by a relatively disproportionately larger phase shift and/or at least one phase-controlled radiator arrangement closest to the center (Z) of the group antenna is fed by a relatively disproportionately low phase shift in such a way that the following inequality is satisfied:

$$Ph_N:Ph_1 \geq S_N:S_1+0.2$$

in which $Ph_N$ and $Ph_1$ represent the phase shifts caused by two different phase shifter settings, $Ph_N$ corresponds to the phase shift, dependent on the phase shift setting, at the at least one radiator arrangement furthest from the center (Z) of the group antenna and $Ph_1$ corresponding to the phase shift at the radiator arrangement closest to the center (Z) of the group antenna, and $S_N$ corresponding to the distance between the at least one furthest radiator arrangement and the center (Z) of the group antenna and $S_1$ corresponding to the distance between the at least one radiator arrangement closest to the center (Z) of the group antenna and the center (Z) of the group antenna, and in which the center (Z) of the group antenna corresponds to the phase-neutral center position, which also remains unchanged with differently set phase positions, and providing a differential phase shifter assembly comprising circular-segment-shaped stripline portions each having first and second port ends connected to different radiator arrangements, of which the radii ($R_N$ to $R_1$) in the case of a group antenna having an odd number of radiator arrangements and/or a phase-neutrally controlled central radiator arrangement satisfy the following conditions:

$$R_N:R_1 \geq n+k$$

in which n is a number 2, 3, 4 . . . N, more specifically corresponding to the number of line portions comprised by the phase shifter assembly used, in which k corresponds to a value within the range of 0.2 to 0.40.

2. Method for operating a phase-controlled group antenna comprising a plurality of radiator arrangements arranged in a direction of assembly and each having at least one radiator or at least one radiator group with a plurality of individual radiators, the distances (D) between two adjacent radiator arrangements being equal or deviating from one another by less than 15% and all or some of the radiator arrangements being controlled via one or more phase shifters for beam pivoting, the method comprising:

feeding at least one outermost radiator arrangement furthest from a center (Z) of the group antenna in the direction of assembly of the radiator arrangement as a function of the setting of the beam pivot by a relatively disproportionately larger phase shift and/or at least one phase-controlled radiator arrangement closest to the center (Z) of the group antenna is fed by a relatively disproportionately low phase shift in such a way that the following inequality is satisfied:

$$Ph_N:Ph_1 \geq S_N:S_1+0.2$$

in which $Ph_N$ and $Ph_1$ represent the phase shifts caused by two different phase shifter settings, $Ph_N$ corresponds to the phase shift, dependent on the phase shift setting, at the at least one radiator arrangement furthest from the center (Z) of the group antenna and $Ph_1$ corresponding to the phase shift at the radiator arrangement closest to the center (Z) of the group antenna, and $S_N$ corresponding to the distance between the at least one furthest radiator arrangement and the center (Z) of the group antenna and $S_1$ corresponds to the distance between the at least one radiator arrangement closest to the center (Z) of the group antenna and the center (Z) of the group antenna, and in which the center (Z) of the group antenna corresponds to the phase-neutral center position, which also remains unchanged with differently set phase positions, and providing a differential phase shifter assembly comprising circular-segment-shaped stripline portions each having first and second port ends connected to different radiator arrangements, of which the radii ($R_N$ to $R_1$ ) in particular in the case of a group antenna having an even number of radiator arrangements and/or without a phase-neutrally controlled central radiator arrangement satisfy the following conditions:

$$R_N:R_1 \geq 2n-k$$

in which n is a number 2, 3, 4 . . . N, more specifically corresponding to the number of line portions comprised by the phase shifter assembly used, and in which k further corresponds to a value within the range of 0.6 to 0.2.

3. Method according to claim 1, including providing the phase shifter assembly stripline portion having the greatest radius ($R_N$) with a dielectric, which is not air, over the entire, or at least some of the length of the stripline portion on at least one or both opposing sides, the dielectric being provided with constant permittivity over the length or partial length.

4. A differential phase shifter assembly comprising:

a plurality of circular-segment-shaped conductor strips, in the form of stripline portions each having first and second port ends for connection to different radiator arrangements, arranged concentrically about a center point, at least one tapping element being displaceable over the line portions, whereby a signal of different phase position can be generated at the opposing ports on the line portions;

wherein when used with a group antenna having an odd number of radiator arrangements with at least one radiator or at least one radiator group or a phase-neutrally controlled central radiator arrangement, the phase shifter assembly satisfies at least one of the two following conditions:

$$R_N:R_1 \geq n+k$$

or $$Ph_N:Ph_1 \geq n+k$$

in which $R_N$ represents the largest radius and $R_1$ represents the smallest radius of a line portion in relation to the phase shifter assembly and n corresponds to a number 2, 3, 4 . . . N, more specifically corresponding to the number of line portions comprised by the phase shifter assembly used, in which k corresponds to a value within the range of 0.2 to 0.40, and $Ph_N$ and $Ph_1$ represent the phase shifts effected by the line portions having the largest radius $R_N$ and the smallest radius $R_1$, which shifts are caused by two different phase shifter settings.

5. A differential phase shifter assembly comprising:

a plurality of circular-segment-shaped conductor stripline portions each having first and second port ends connected to different radiator arrangements, the stripline portions being arranged concentrically about a center point, at least one tapping element being displaceable over the line portions, whereby a signal of different phase position can be generated at the opposing ports on the line portions, wherein, with use of a group antenna having an even number of radiator arrangements or without a phase-neutral center feed, the phase shifter assembly satisfies at least one of the two following conditions:

$$R_N:R_1 \geq 2n-k$$

or $$Ph_N:Ph_1 \geq 2n-k$$

in which $R_N$ represents the largest radius and $R_1$ represents the smallest radius of a line portion in relation to the phase shifter assembly and n corresponds to a number 2, 3, 4 . . . N, more specifically corresponding to the number of line portions comprised by the phase shifter assembly used, in which k corresponds to a value within the range of 0.6 to 0.2, and $Ph_N$ and $Ph_1$ represent the phase shifts effected by the line portions having the largest radius $R_N$ and the smallest radius $R_1$, which shifts are caused by two different phase shifter settings.

6. Phase shifter assembly according to claim 4, wherein with a phase-neutral center feed provided in addition to the phase shifter assembly for a group antenna, the phase shifter assembly satisfies the following conditions:

$$Ph_N:Ph_1 \leq n+m$$

in which n is a natural number 2, 3, 4 . . . N, corresponding to the number of circular-segment-shaped line portions and m has a value within the range of 2.0 to 1.0.

7. Phase shifter assembly according to claim 4, wherein the phase shifter assembly, without phase-neutral center feed for a group antenna, satisfies the following condition:

$$Ph_N:Ph_1 \leq 2n+m$$

in which n is a natural number 2, 3, 4 . . . N, corresponding to the number of circular-segment-shaped line portions and m has a value within the range of 3.0 to 2.0.

8. Phase shifter assembly according to claim 4, wherein the radii ($R_N$ to $R_1$ ) of the circular-segment-shaped line portions, in the case of feeding a group antenna with a phase-neutral center feed, satisfies the following condition:

$$R_N:Rh_1 \geq n+k$$

in which n corresponds to a number 2, 3, 4 . . . N, more specifically corresponding to the number of line portions comprised by the phase shifter assembly used, in which k has a value within the range of 0.2 to 0.40.

9. Phase shifter assembly according to claim 4, wherein the radii ($R_N$ to $R_1$) of the circular-segment-shaped line portions, in the case of a group antenna without phase-neutral center feed, satisfies the following condition:

$$R_N:Rh_1 \geq 2n-k$$

in which n corresponds to a number 2, 3, 4 . . . N, more specifically corresponding to the number of line portions comprised by the phase shifter assembly used, in which has a value within the range of 0.6 to 0.2.

10. Phase shifter assembly according to claim 4, wherein the stripline portion having the largest radius ($R_N$) is provided with a dielectric, which is not air, on at least one side over its entire length or a partial length, which dielectric is provided with constant or different thickness and/or with constant or different permittivity.

11. Phase-controlled group antenna comprising:

a group antenna comprising a plurality of radiator arrangements provided at equal distances (D) in a direction of assembly, which arrangements comprise at least one radiator or a radiator sub-group, the group antenna containing one or more phase shifters for beam pivoting, at least one outermost radiator arrangement furthest from a center (Z) of the group antenna in the direction of assembly of the radiator arrangement, as a function of the setting of the beam pivot, experiencing a relatively disproportionately larger phase shift and/or at least one phase-shifter-controlled radiator arrangement closest to the center of the group antenna experiences a relatively disproportionately low phase shift in such a way that the following inequality is satisfied:

$$Ph_N:Ph_1 \geq S_N:S_1+0.2$$

in which $Ph_N$ and $Ph_1$ represent phase shifts caused by two different phase shifter settings or the maximum phase shift, and $Ph_N$ corresponds to the phase shift at the at least one radiator arrangement furthest from the center (Z) of the group antenna and $Ph_1$ corresponds to the phase-controlled phase shift at the radiator arrangement closest to the center (Z) of the group antenna, and $S_N$ corresponds to the distance between the at least one furthest radiator arrangement and the center (Z) of the group antenna and $S_1$ corresponds to the distance between the at least one radiator arrangement closest to the center (Z) of the group antenna and the center (Z) of the group antenna, and in which the center (Z) of the group antenna corresponds to the phase-neutral center position, which also remains unchanged with differently set phase positions, and a differential phase shifter assembly according to claim 4.

* * * * *